US008382233B2

(12) United States Patent
Usui et al.

(10) Patent No.: US 8,382,233 B2
(45) Date of Patent: Feb. 26, 2013

(54) HEAD CLEANING DEVICE, IMAGE FORMING DEVICE, AND HEAD CLEANING METHOD

(75) Inventors: Yuuma Usui, Kanagawa (JP); Takeo Tsukamoto, Kanagawa (JP); Aino Hasegawa, Kanagawa (JP); Manabu Seo, Kanagawa (JP); Takeshi Orito, Kanagawa (JP); Ryota Suzuki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 13 days.

(21) Appl. No.: 13/138,191

(22) PCT Filed: Mar. 4, 2010

(86) PCT No.: PCT/JP2010/054064

§ 371 (c)(1),
(2), (4) Date: Jul. 18, 2011

(87) PCT Pub. No.: WO2010/104136

PCT Pub. Date: Sep. 16, 2010

(65) Prior Publication Data

US 2012/0050393 A1 Mar. 1, 2012

(30) Foreign Application Priority Data

Mar. 10, 2009 (JP) ..... 2009-056648

(51) Int. Cl.
*B41J 2/165* (2006.01)

(52) U.S. Cl. ..... 347/21

(58) Field of Classification Search ..... None
See application file for complete search history.

(56) References Cited

U.S. PATENT DOCUMENTS

| | | | |
|---|---|---|---|
| 5,541,628 | A | 7/1996 | Chang et al. |
| 5,557,306 | A | 9/1996 | Fukushima et al. |
| 5,617,121 | A | 4/1997 | Tachihara et al. |
| 2001/0022601 | A1 | 9/2001 | Ishii et al. |

FOREIGN PATENT DOCUMENTS

| | | | |
|---|---|---|---|
| JP | 57-061576 | A | 4/1982 |
| JP | 03-247461 | A | 11/1991 |
| JP | 9029985 | A | 2/1997 |
| JP | 10-151759 | A | 6/1998 |
| JP | 10-202904 | A | 8/1998 |

(Continued)

OTHER PUBLICATIONS

English language abstract for JP-2002-166562 which corresponds to JP-3926094-B2.

*Primary Examiner* — Matthew Luu
*Assistant Examiner* — Alejandro Valencia
(74) *Attorney, Agent, or Firm* — Harness, Dickey & Pierce, P.L.C.

(57) ABSTRACT

A head cleaning device includes an electrode disposed in a position confronting to a bottom of a head in a cleaning position, the head including nozzles for discharging a water-soluble ink, the electrode being set in a covered state to provide a surface covered with an electrolyte which, when electrolyzed, dissolves the water-soluble ink. A liquid supplying unit supplies the electrolyte to the electrode so that the electrode is set in the covered state. A voltage supplying unit supplies a voltage between the head and the electrode to electrolyze the electrolyte on the surface of the electrode in the covered state.

13 Claims, 13 Drawing Sheets

FOREIGN PATENT DOCUMENTS

| | | | |
|---|---|---|---|
| JP | 11-058752 | A | 3/1999 |
| JP | 2001-205816 | A | 7/2001 |
| JP | 2001-232805 | A | 8/2001 |
| JP | 3926094 | B2 | 6/2002 |
| JP | 2003-001839 | A | 1/2003 |
| JP | 2003-039689 | A | 2/2003 |
| JP | 3480494 | B2 | 12/2003 |
| JP | 2004-136534 | A | 5/2004 |
| JP | 3535885 | B2 | 6/2004 |

HEAD CLEANING DEVICE, IMAGE FORMING DEVICE, AND HEAD CLEANING METHOD

TECHNICAL FIELD

This invention relates to a head cleaning device and a head cleaning method which are adapted to clean a head for discharging ink drops in an image forming device to perform image formation using ink, such as an ink-jet printer, and relates to an image forming device including the head cleaning device.

BACKGROUND ART

Conventionally, an image forming device, such as an ink-jet printer, which includes a head for discharging ink drops from the nozzles of the head, is known. Generally, one major problem that often arises in the image forming device and is detrimental to the performance of image formation with good quality is clogging of the nozzles of the head or dirt around the nozzles of the head. To avoid the problem, various preventive measures for preventing the occurrence of clogging, dirt, etc. in the image forming device have been proposed. For example, refer to the following related art documents.

Document 1: Japanese Patent No. 3480494 (Japanese Laid-Open Patent Publication No. 2003-001857)

Document 2: Japanese Laid-Open Patent Publication No. 03-247461

Document 3: Japanese Laid-Open Patent Publication No. 2003-001839

Document 4: Japanese Laid-Open Patent Publication No. 10-202904

Document 5: Japanese Laid-Open Patent Publication No. 57-061576

Document 6: Japanese Laid-Open Patent Publication No. 2001-205816

Document 7: Japanese Patent No. 3535885 (Japanese Laid-Open Patent Publication No. 07-096604)

Document 8: Japanese Laid-Open Patent Publication No. 2003-39689

Document 9: Japanese Laid-Open Patent Publication No. 10-151759

Document 10: Japanese Patent No. 3926094 (Japanese Laid-Open Patent Publication No. 2002-166562)

Document 11: Japanese Laid-Open Patent Publication No. 2001-232805

However, the preventive measures proposed by the related art documents have the difficulty respectively, which will be explained below, and it is desired to develop new preventive measures for preventing the occurrence of clogging, dirt, etc. in the image forming device.

Specifically, one of the preventive measures according to the related art documents (for example, Document 1 or Document 2) is to perform a discharge recovering operation which discharges ink drops from the nozzles at times other than the time of image formation, in order to prevent the occurrence of clogging of the nozzles. Another of the preventive measures according to the related art documents (for example, Document 2, Document 3 or Document 4) is to attract ink from the nozzles at times other than the time of image formation, in order to prevent the occurrence of clogging of the nozzles. In these cases, there is the difficulty in that a certain amount of ink is wasted.

One of the preventive measures according to the related art documents (for example, Document 5) is to drive the head to a degree that does not cause ink drops to be discharged from the nozzles, in order to prevent the occurrence of clogging of the nozzles. In this case, if the head is left unused for a long time in a power-down state of the ink-jet printer, the viscosity of the ink is increased due to drying and there is the difficulty that clogging of the nozzles will easily occur.

One of the preventive measures according to the related art documents (for example, Document 2, Document 3 or Document 4) is to attach a cap to the head at times other than the time of image formation. In this case, the preventive measure for preventing occurrence of dirt around the nozzles at the time of image formation is inadequate. If the cap becomes dirty over an extended period of time, the head will be stained by the dirt in the cap.

One of the preventive measures according to the related art documents (for example, Document 4, Document 6, Document 7 or Document 8) is to allow a blade of an elastic material to contact the nozzle surface of the head in order to remove the remaining ink which cause clogging of the nozzles or dirt in the nozzles. In this case, there is the difficulty in that, when the viscosity of the ink is increased due to drying, the removal of the remaining ink is not performed adequately.

One of the preventive measures according to the related art documents (for example, Document 9 or Document 10) is to apply a cleaning liquid (which dissolves the ink by itself) to the nozzle surface of the head so that the dirt adhering to the nozzle surface of the head is dissolved by the cleaning liquid. In this case, if the cleaning liquid is scattered, another contamination may arise due to the cleaning liquid. There is also the difficulty in that the cleaning performance will be lowered due to deterioration of the cleaning liquid over an extended period of time and the use of the cleaning liquid will raise the cost.

One of the preventive measures according to the related art is to immerse the head in a container which is covered with a cleaning liquid, in order to clean the nozzle surface of the head. In this case, there is the difficulty in that the cleaning performance will be lowered due to deterioration of the cleaning liquid over an extended period of time. There is also the difficulty in that the use of the cleaning liquid will raise the cost. Moreover, the preventive measures of this type will require the container with a size in which the head can be immersed and the additional device for driving the head so that the head is immersed in the container. This will enlarge the image forming device in size.

DISCLOSURE OF THE INVENTION

In one aspect of the invention, the present disclosure provides a head cleaning device and a head cleaning method which are adapted to clean, by novel and useful preventive measures, a head for discharging ink drops in an image forming device which performs image formation using the ink, such as an ink-jet printer, and provides an image forming device including the head cleaning device.

In an embodiment of the invention which solves or reduces one or more of the above-mentioned problems, the present disclosure provides a head cleaning device including: an electrode disposed in a position confronting to a bottom of a head in a cleaning position, the head including nozzles for discharging a water-soluble ink, the electrode being set in a covered state to provide a surface covered with an electrolyte which, when electrolyzed, dissolves the water-soluble ink; a liquid supplying unit that supplies the electrolyte to the electrode so that the electrode is set in the covered state; and a voltage supplying unit that supplies a voltage between the head and the electrode to electrolyze the electrolyte on the surface of the electrode in the covered state.

In an embodiment of the invention which solves or reduces one or more of the above-mentioned problems, the present disclosure provides a head cleaning method using a head cleaning device, the head cleaning method including: providing an electrode disposed in a position confronting to a bottom of a head in a cleaning position, the head including nozzles for discharging a water-soluble ink, the electrode being set in a covered state to provide a surface covered with an electrolyte which, when electrolyzed, dissolves the water-soluble ink; supplying, by a liquid supplying unit of the head cleaning device, the electrolyte to the electrode so that the electrode is set in the covered state; and supplying, by a voltage supplying unit of the head cleaning device, a voltage between the head and the electrode to electrolyze the electrolyte on the surface of the electrode in the covered state.

BEST MODE FOR CARRYING OUT THE INVENTION

A description will be given of embodiments of the invention with reference to the accompanying drawings.

Figure 1:
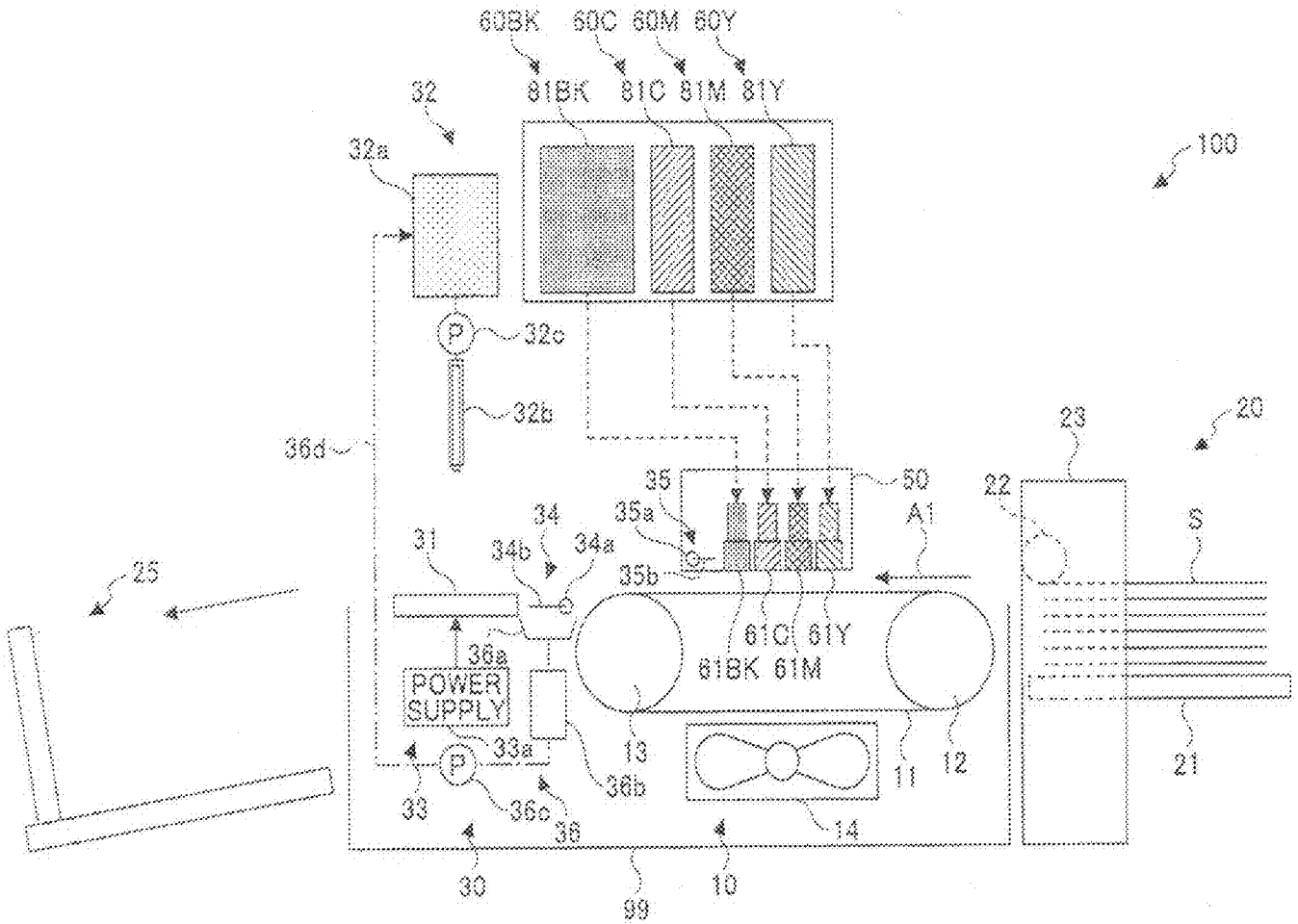
FIG. 1 is a front view illustrating the composition of an image forming device including a head cleaning device of an embodiment of the invention.

FIG. 1 illustrates the composition of an image forming device of an embodiment of the invention. The image forming device 100 in FIG. 1 is an ink-jet printer which is arranged to perform full color image formation using ink. The image forming device 100 performs an image formation process based on an image signal corresponding to the image information which is received from an external device.

The image forming device 100 forms an image on any of sheet-like recording media including plain copy sheets, OHP sheets, cardboards, such as cards, postcards, envelopes, etc. The image forming device 100 of this embodiment is a one-sided image forming device which performs image formation on one side of a copy sheet S which is a recording medium. Alternatively, the image forming device 100 may be a double-sided image forming device which performs image formation on both sides of a copy sheet S.

The image forming device 100 includes a plurality of heads 61Y, 61M, 61C, 61BK which are able to form respective images of colors of yellow, magenta, cyan, black by discharging ink drops of the respective colors to an image support. The images are superimposed on the image support in a controlled manner so that a full-color image is formed in combination. The image forming device 100 includes a tandem type printing head in which the heads 61Y, 61M, 61C, 61Bk are arranged side by side in parallel to a horizontal direction.

The heads 61Y, 61M, 61C, 61Bk are located over a belt 11 (a recording sheet transporting belt) which is constituted by an endless belt disposed in the center of a main part 99 of the image forming device 100, and disposed in a position confronting to the peripheral surface of the belt 11. The heads 61Y, 61M, 61C, 61Bk are arrayed in this order from the upstream side in the movement direction of the belt 11 (which direction is the counter clockwise direction indicated by the arrow A1 in FIG. 1). In FIG. 1, the characters Y, M, C, BK, followed by each reference numeral, denote yellow, magenta, cyan, black, respectively.

The heads 61Y, 61M, 61C, 61BK are respectively provided with ink discharging devices 60Y, 60M, 60C, 60Bk for forming the images of yellow (Y), magenta (M), cyan (C), black (BK). As indicated by reference numeral 61 in FIG. 2, the heads 61Y, 61M, 61C, 61BK are arranged side by side in the main scanning direction parallel to the horizontal direction in FIG. 2 corresponding to the direction perpendicular to the paper of FIG. 1, and arranged in the ink discharging devices 60Y, 60M, 60C, 60BK respectively.

The belt 11 is conveyed in the A1 direction, with a copy sheet S held on the peripheral surface of the belt 11 such that the copy sheet S faces each of the heads 61Y, 61M, 61C, 61BK. In this process, the inks of yellow, magenta, cyan, black are sequentially discharged in a superimposing manner from each of the heads 61Y, 61M, 61C, 61BK, and a color image is formed on the copy sheet S. The belt 11 includes a plurality of pores (not illustrated) formed in order to attract and hold the copy sheet S (which will be described later).

The discharging of the inks to the copy sheet S by the heads 61Y, 61M, 61C, 61BK is performed at a shifted timing from the A1 direction upstream to the downstream, so that the image ranges of the inks of yellow, magenta, cyan, black are overlapped over the copy sheet S in the same position.

As illustrated in FIG. 1, the image forming device 100 includes the ink discharging devices 60Y, 60M, 60C, 60BK provided with the heads 61Y, 61M, 61C, 61BK, respectively, and a recording sheet transporting unit 10 which is provided with the belt 11 and conveys the copy sheet S by attracting and holding the copy sheet S onto the belt 11. The image forming device 100 includes a paper feeding unit 20 which supplies, to the transporting unit 10, the uppermost copy sheet S among the multiple copy sheets S loaded in the paper feeding unit 20.

The image forming device 100 includes an ejection part 25 to which the copy sheet S with the image printed is conveyed by the transporting unit 10, so that the copy sheet S is stacked on the ejection part 25. The image forming device 100 includes a head cleaning device 30 which is disposed between the transporting unit 10 and the ejection part 25 and cleans the heads 61Y, 61M, 61C, 61Bk.

The image forming device 100 further includes a carriage 50 in which the heads 61Y, 61M, 61C, 61BK are integrally supported, and a head movement driving unit (which is not illustrated) which includes the motor as a driving and positioning source. The head movement driving unit moves the carriage 50 (and positions each head of the carriage 50) to selectively one of the home position (or image formation position where image formation is performed) as illustrated in FIG. 1 and the cleaning position (where each head faces the head cleaning device 30) as illustrated in FIG. 3C.

Figure 2:
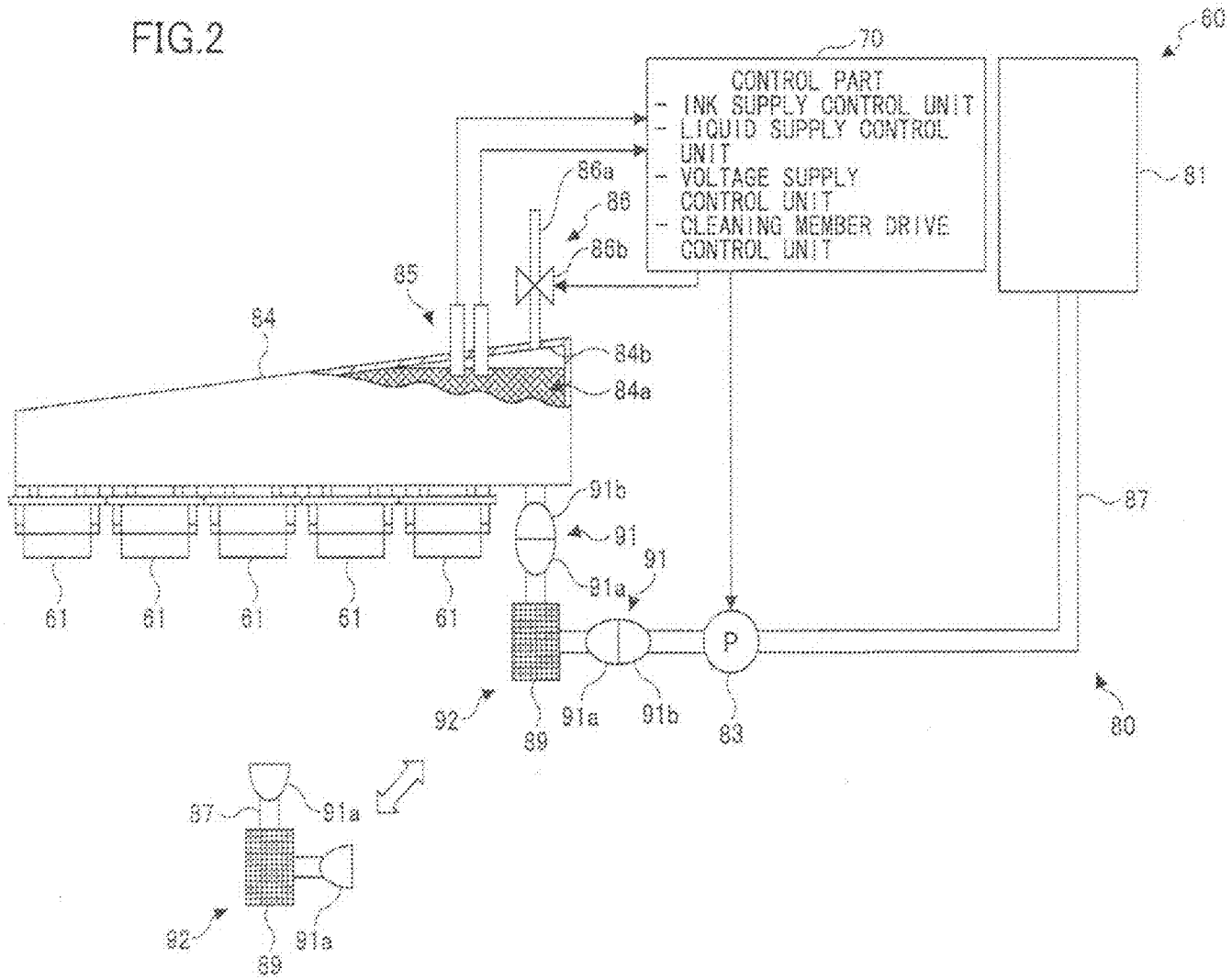
FIG. 2 is a diagram illustrating an ink discharging device provided in the image forming device illustrated in FIG. 1 and including a head.

The image forming device 100 further include a control part 70 (as illustrated in FIG. 2) which includes a CPU (which is not illustrated) to control operation of the image forming device 100, a memory, etc.

As illustrated in FIG. 1, other than the belt 11, the transporting unit 10 includes a driving roller (driving member) and a follower roller 13 (follower member), around which the belt 11 is wound, a fan 14 disposed under the belt 11, and a motor (which is not illustrated) as a driving source for rotating the driving roller 12. The fan 14 is an air attraction fan which forms, through the pores formed in the belt 11, an air flow in the direction to generate a negative pressure between the peripheral surface of the belt 11 and the copy sheet S, to attract the rear face of the copy sheet S and hold it on the top surface of the belt 11.

The paper feeding unit 20 includes a paper feed tray 21 in which multiple copy sheets S can be loaded, a feed roller 22 which supplies, to the transporting unit 10, the uppermost copy sheet S among the copy sheets S loaded in the paper feed tray 21, a housing 23 in which the paper feed tray 21 and the feed roller 22 are supported, and a motor (which is not illustrated) as a driven unit to rotate the feed roller 22 and feed the copy sheet S in conformity with the timing of the ink discharging by the heads 61Y, 61M, 61C, 61BK.

When any of the heads 61Y, 61M, 61C, 61BK deteriorates and it is needed to exchange it with a new one, the carriages 50 is formed integrally with the heads 61Y, 61M, 61C, 61BK and detachably attached to the main part 99 in order to make the maintenance easy.

With reference to FIG. 2 and FIG. 4, the ink discharging devices 60Y, 60M, 60C, 60BK will be described. Although the color of the ink to be used in the ink discharging devices 60Y, 60M, 60C, 60BK differs, these devices have the same composition. For the sake of convenience, the ink discharging devices 60Y, 60M, 60C, 60BK will be collectively referred to as the ink discharging device 60, and the characters Y, M, C, BK followed by each reference numeral will be omitted.

As illustrated in FIG. 2, the ink discharging device 60 includes a plurality of heads 61 arrayed side by side in the main scanning direction, and an ink supplying device 80 that constitutes an ink supply system which supplies the ink to these heads 61. The ink discharging device 60 and the image forming device 100 are arranged in a full-line formation.

The ink supplying device 80 includes an ink cartridge 81 as a main tank which contains the ink of a corresponding color to be supplied to the heads 61. The ink supplying device 80 includes a pump 83 as a feed pump for collecting the ink contained in the ink cartridge 81 and feeding the ink to each of the heads 62 under pressure. The ink supplying device 80 includes a distributor tank 84 which is an ink supply part which temporarily stores the ink supplied from the ink cartridge 81 by the pump 83, and distributes the ink to each of the heads 61.

The ink supplying device 80 includes: an ink quantity detection sensor 85 (ink quantity detection unit) which detects the quantity of ink remaining in the distributor tank 84 in order to detect lack of the ink remaining in the distributor tank 84; an exhaust unit 86 which exhausts the air in the distributor tank 84 outside; a pipe 87 which forms the feeding passage of the ink between the ink cartridge 81 and the distributor tank 84 with the pump 83, and several pipes 88 which form the feeding passages of the ink between the distributor tank 84 and the heads 61.

The ink supplying device 80 includes a filter 89 which is disposed near an inlet opening of the pipe 87 (where the ink from the ink cartridge 81 enters the distributor tank 84) in the position between the pump 83 and the distributor tank 84. The filter 89 acts to the ink which flows into the distributor tank 84. Fasteners 91 are disposed in the halfway part of the pipe 87 on both sides of the filter 89 in the direction of the ink flow.

In order to make the maintenance easy, the ink cartridge 81 is detachably attached to the main part 99, so that it may be exchangeable with a new one when the ink is consumed and runs short. The ink contains at least a coloring material corresponding to one of yellow, magenta, cyan, and black, and a solvent of the coloring material. The solvent contains at least water and the ink is a water-soluble ink. The ionicity of the coloring material in the solvent is the anion type.

Operation of the pump 83 is controlled by the control part 70. Specifically, when lack of the ink in the distributor tank 84 is detected by the ink quantity detection sensor 85 and the discharging of the ink by the head 61 is stopped, the control part 70 drives the pump 83 to supply the ink in the ink cartridge 81 to the distributor tank 84 until the lack of the ink in the distributor tank 84 is no longer detected. The control part 70 functions as an ink supply control unit. Unless otherwise specified, the control part 70 controls the driving operation of the component parts of the image forming device 100.

The distributor tank 84 supplies ink to each of the heads 61 directly. The distributor tank 84 includes a container part 84*a* containing the ink, and one end of a pipe 87 is connected to the container part 84*a* near at its bottom end in the horizontal direction. Through the pipe 87, the ink from the ink cartridge 81 is supplied to the container part 84*a*. The distributor tank 84 includes an inclined top surface 84*b* as one of the inner surfaces of the container part 84*a*, such that the end portion to which the pipe 87 is connected is placed in a higher location and the top surface 84*b* is inclined downward in the ink flow direction from the side of the filter 89.

The ink quantity detection sensor 85 is a liquid-level detection sensor which detects a liquid level of the ink in the container part 84*a* and outputs a detection signal indicating whether the sensor 85 is wetted by the ink, to the control part 70. The state where ink quantity detection sensor 85 is not flooded with ink is in the state which has produced lack of ink, and is in the state which should supply ink in container part 84*a*. Based on this signal, the control part 70 determines whether the ink in the container part 84*a* runs short, when not having flooded ink quantity detection sensor 85 with ink.

The pipe 86*a* is disposed so that the exhaust unit 86 might open the space of the inside and outside of container part 84*a* for free passage in the position where the top surface 84*b* occupies a high order most, or its neighborhood, i.e., a crowning. It include a bubble removing electromagnetic valve 86*b* which switches whether it is disposed in the halfway part of pipe 86*a*, and the space of the inside and outside of the container part 84*a* is opened for free passage. The portion which is a bottom end of the pipe 86*a* and is open for free passage to the container part 84*a* occupies the position higher than the lower end position of ink quantity detection sensor 85.

As for the electromagnetic valve 86*b*, opening and closing are controlled by the control part 70. The electromagnetic valve 86*b* is opened when the control part 70 drives the pump and the ink flows in the container part 84*a*, and specifically, thereby, the air in the container part 84*a* is discharged outside from the top surface 84*b*. At this time, the control part 70 functions as an exhaust control unit. When the exhaust unit 86 functions as an air removing unit, the control part 70 functions as an air removing control unit.

Because the position which pipe 86*a* and container part 84*a* are opening for free passage is one of positions higher than the lower end position of ink quantity detection sensor 85, even the ink in the container part 84*a* is not discharged outside.

The pipe 87 corresponds to the portion indicated by the arrow of the one-dot chain line of FIG. 1, and the ink flows in the direction illustrated by the arrow. The pipe 88 corresponds to the portion illustrated by the arrow of the dotted line of FIG. 1, and the ink flows in the direction indicated by the arrow. The pipe 88 is disposed to connect the distributor tank 84 and each head 61, and practically, it is provided in the distributor tank 84 and/or each head 61.

The filter 89 is to remove foreign matters of particles contained in the ink in the ink cartridge 81 and having comparatively small diameters, such as a contaminant or an ink condensation foreign matter, by filtering. The filter 89 is to remove impurities or foreign matters of large drops with comparatively large diameters, contained or mixed in the ink in the ink passages from the ink cartridge 81, the pump 83 and the pipe 87, by filtering, in order to prevent that this impurity reduces the image quality, that the impurity causes clogging of the head 61 and the image quality deteriorates, etc. Therefore, filtration precision is high in piles about a lattice-like mesh (not shown) at many layers, and the filter 89 has become what has comparatively small supplementary particle diameter, in order to catch the impurity containing the foreign matters of the size.

However, if air bubbles may be formed and these air bubbles result in the head 61 when the ink passes through the filter 89, if the supplementary particle diameter of filter 89 and the size of what is called an eye are made small in this way, it can become the cause of reducing image quality. The distributor tank 84 and exhaust unit 86 are formed in order that these air bubbles may prevent advancing into head 61.

While the air bubbles which enter into the distributor tank 84 are contained in the distributor tank 84 and flow through the inside of distributor tank 84 again, they reach the top surface 84*b*. It goes up along the top surface 84, in this arranging position, it gathers until it reaches the arranging position of pipe 86*a*, and it is discharged out of distributor tank 84 with exhaust unit 86.

Therefore, the exhaust unit 86 and/or the distributor tank 84 function as an air removing unit which will perform degassing of ink which passed filter 89 by the time of entry of ink into the head 61.

Each fastener 91 has detaching part 91*a* located in the filter 89 side, and covering depart 91*b* which detaching part 91*a* is fitted airtightly, and has detaching part 91*a* detached and attached. Thereby, the pipe 87 of the portion located between filter 89, detaching part 91*a*, and filter 89 and detaching part 91*a* constitutes filter cartridge 92 detached and attached to the main part of ink supplying device 80, and the main part of ink discharging device 60.

As mentioned above, since the filter 89 has the pores of the small size, if it is easy to start clogging by capture of a temporal impurity and clogging is started, the resistance to passage of ink will become large and it will become difficult to flow through ink.

However, in order to make the maintenance easy corresponding to the fixed exchange, the filter 89 is exchangeable to a new component. By the filter cartridge 92, it can detach and attach to the main part of ink supplying device 80, and the main part of ink discharging device 60. This enables the clearing operation and the maintenance to be easily performed.

As illustrated in FIG. 4, the head 61 is arranged so that the ink discharge side faces downward. The head 61 includes a conductive orifice 61*a* (which is a conductive member), and an insulating orifice 61*b* (which is an insulating member), and a minute nozzle 61*c* which is the opening formed in the conductive orifice 61*a* and the insulating orifice 61*b* for free passage.

Figure 4A:
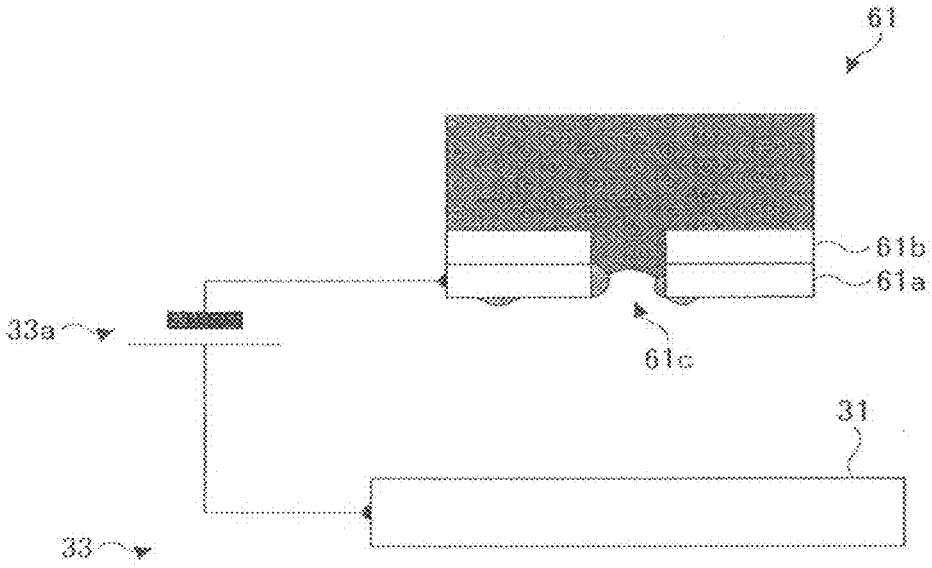
FIG. 4A, FIG. 4B, and FIG. 4C are diagrams for explaining conditions in which the head is cleaned by the head cleaning device when the cleaning operation illustrated in FIGS. 3A to 3D is performed.
Figure 4B:
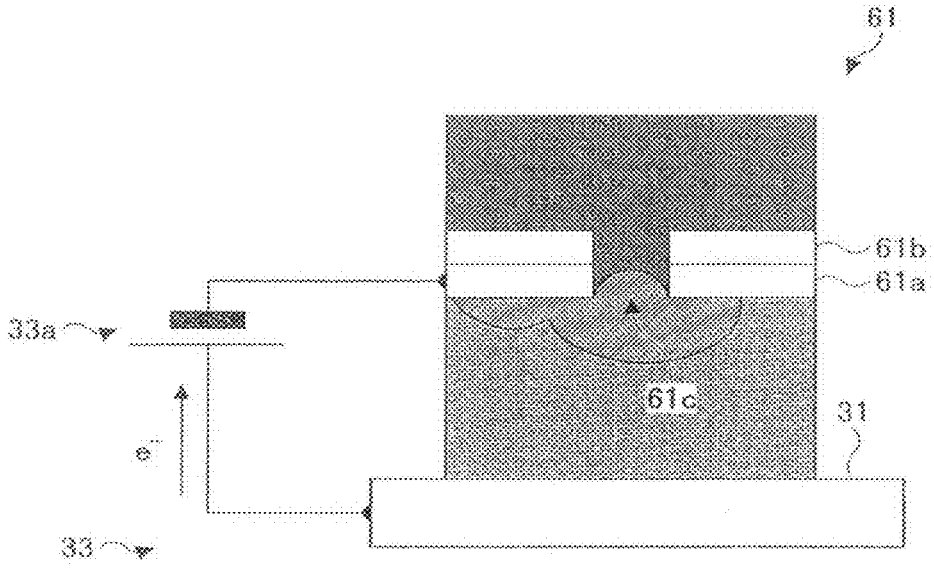
Figure 4C:
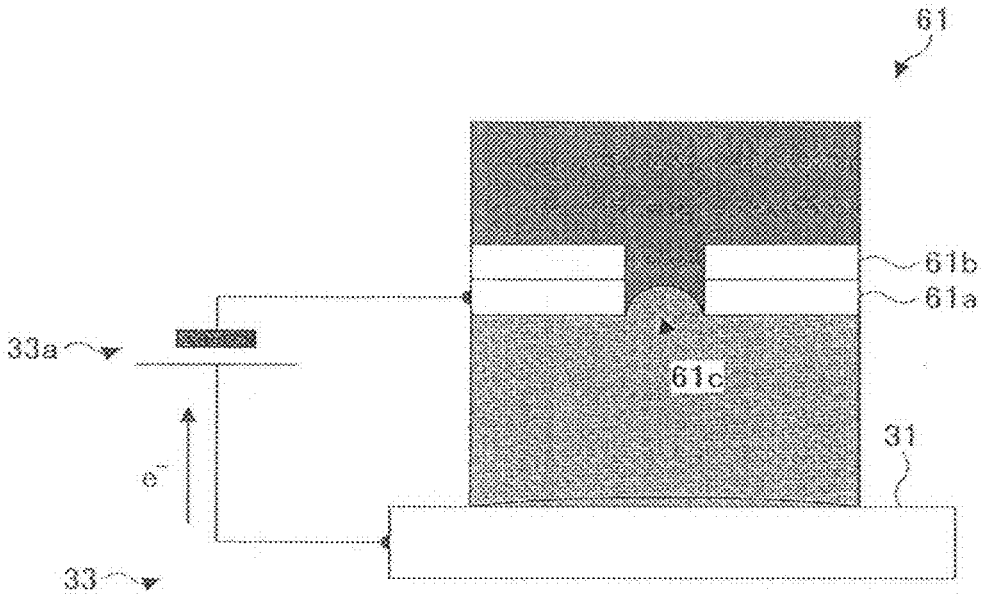

The head 61 includes a movable actuator of piezoelectric type (not illustrated) which discharges the ink from the nozzle 61*c* to a target position of a copy sheet S. This actuator may be a movable actuator of another type. In addition, the head 61 may discharge ink from the nozzle 61*c* using a heating film-boiling method, such as a thermal method. Each head 61 is provided with many nozzles 61*c* but, for the sake of convenience, only one of the nozzles is illustrated in the example of FIGS. 4A to 4C.

The conductive orifice 61*a* is provided to form the surface of the head 61 on the ink discharge side. Because the conductive orifice 61*a* is provided as an anode, it is unnecessary to use a material having a resistance to metal melting for the conductive orifice 61*a*. The conductive orifice 61*a* is made of a highly conductive material, such as a metal or carbon.

In order to insulate between the ink contained in the head 61 and the conductive orifices 61*a*, the insulating orifice 61*b* is formed therebetween. The material of the insulating orifice 61*b* is not limited if it has an insulating property.

In this embodiment, the head 61 has a dual-layer structure in which the conductive orifice 61*a* and the insulating orifice 61*b* are joined together. Alternatively, other layers may be interposed between the insulating orifice 61*b* and the ink well, and it is not necessary to join together the conductive orifice 61*a* and the insulating orifice 61*b*.

In the ink discharging device 60 and the ink supplying device 80 of this embodiment, when ink is discharged from the head 61 during the image formation operation, various impurities are removed from the ink by the filter 89. When the bubbles are contained in the ink passing through the filter 89, the bubbles are removed from the ink by the exhaust unit 86. The discharging of the ink is performed appropriately resulting in the image formation with good quality. even if clogging of the filter 89 arises, the exchanging operation of the filter 89 can be easily performed which provides the ease of maintenance.

As illustrated in FIG. 1, the head cleaning device 30 includes an electrode 31 which is disposed in a position confronting to the bottom of the heads 61Y, 61M, 61C, 61BK in a cleaning position. The head cleaning device 30 includes a liquid supplying unit 32 (or electrolyte supplying unit) which supplies to the electrode 31 an electrolyte for dissolving the ink used in the image forming device 100, so that the electrode 31 is set in a covered state to provide a surface covered with the electrolyte for the heads 61Y, 61M, 61C, 61BK in the cleaning position.

The head cleaning device 30 includes a voltage supplying unit 33 which supplies a voltage between the electrode 31 and the heads 61Y, 61M, 61C, 61BK, the voltage electrolyzing the electrolyte.

The head cleaning device 30 includes a first cleaning unit 34 which removes the electrolyte from the heads 61Y, 61M, 61C, 61BK to which the voltage is supplied by the voltage supplying unit 33. The head cleaning device 30 includes a second cleaning unit 35 which removes the electrolyte from the electrode 31 to which the voltage is supplied by the voltage supplying unit 33. The head cleaning device 30 includes a recycling unit 36 which collects the electrolyte removed from the heads 61Y, 61M, 61C, 61BK and from the electrode 31 by the first cleaning unit 34 and second cleaning unit 35, and recycles the collected electrolyte to the liquid supplying unit 32.

The electrode 31 is a plate-like component positioned so that the heads 61Y, 61M, 61C, 61BK in the cleaning position, and the prescribed interval mentioned later. Because it has electrode 31 as a cathode so that it may mention later although it should just comprise a conductive material, when it constitutes from a metallic material, it is desirable to consider it as material with the resistance over metal leaching, such as gold and platinum, and an oxide film may be formed in order to increase the resistance over metal leaching.

In order to reduce the cost, the material of the electrode 31 may be carbon. When the electrode 31 is made of carbon, amorphous carbon, such as glassy carbon, may be used as the material of carbon, the carbon of the shape of a grain or fibrous may be mixed with binder resin and an elastomer, and electrode 31 may be fabricated.

The tank 32*a* as an electrolyte container part by which the liquid supplying unit 32 contained the electrolyte, the nozzle 32*b* which supplies the electrolyte in the tank 32*a* to the electrode 31, and the pump 32*c* to which the electrode 31 is made to turn and supply the electrolyte in tank 32*a* from nozzle 32*b*. It includes a liquid supply control unit which is realized by one of the functions of the control part 70, and controls the drive timing of pump 32*c*, and driving time.

Figure 3A:
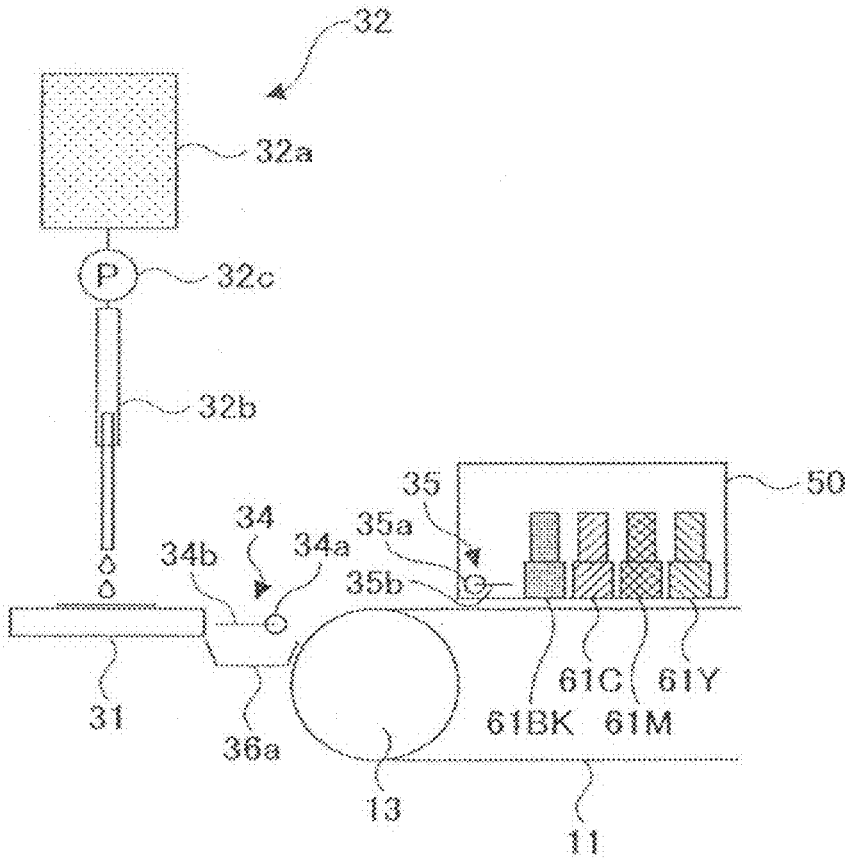
FIG. 3A, FIG. 3B, FIG. 3C, and FIG. 3D are diagrams for explaining operation of the head cleaning device of the present embodiment when a cleaning operation of the head is performed in the image forming device illustrated in FIG. 1.
Figure 3B:
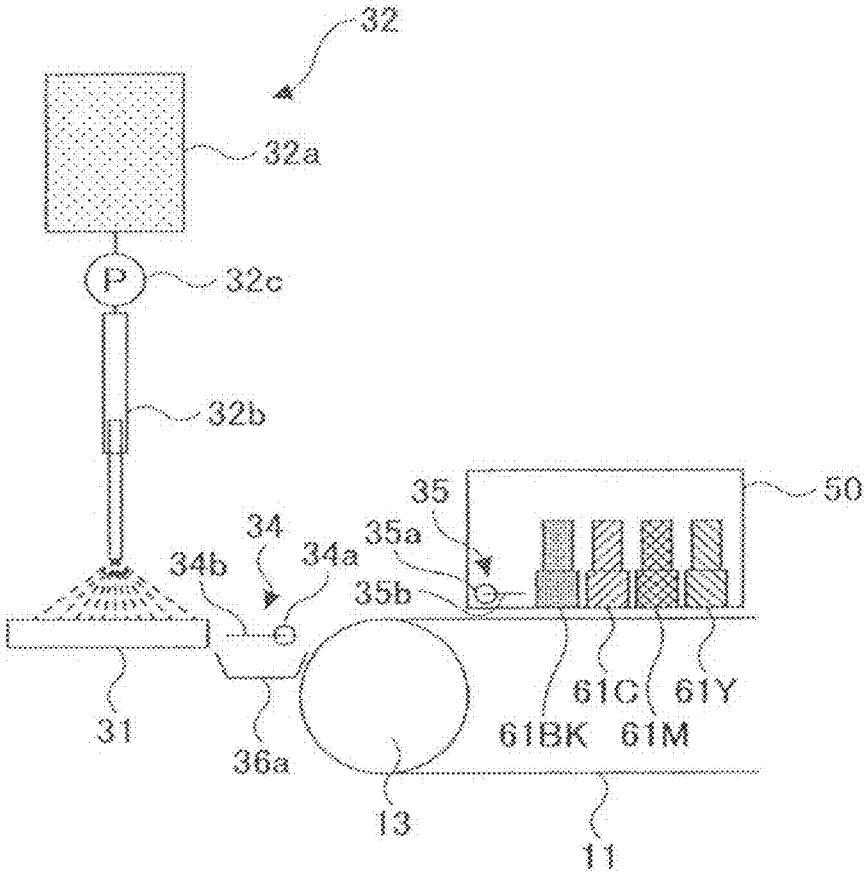
Figure 3C:
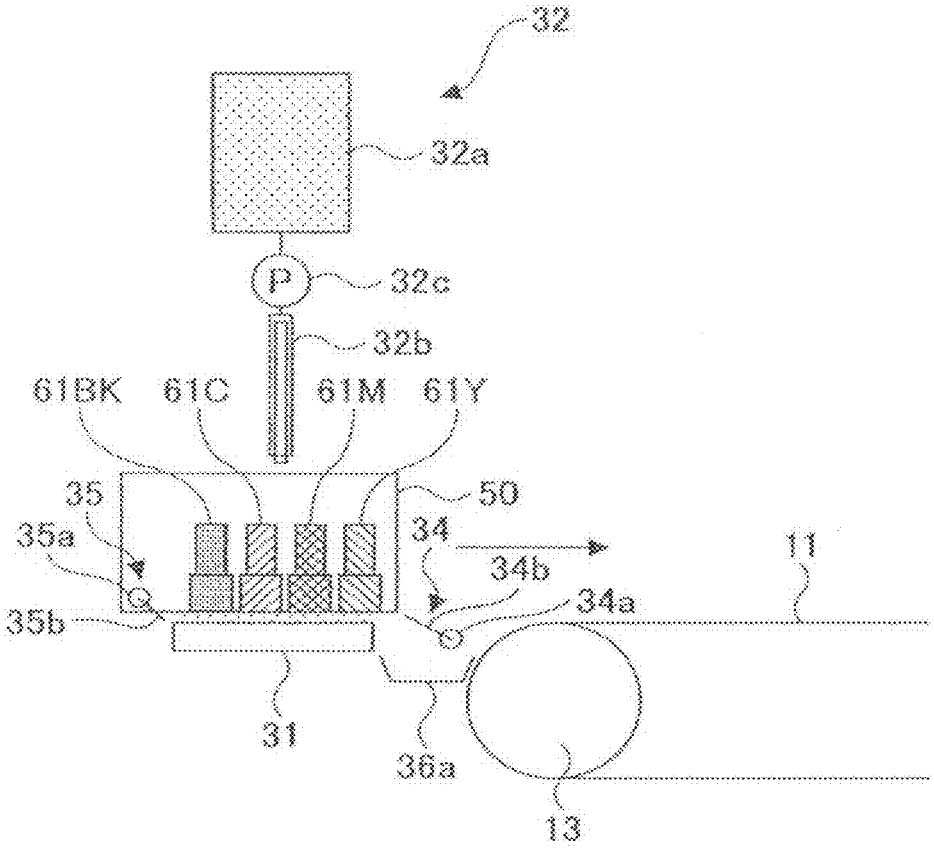

As illustrated in FIG. 3A and FIG. 3B, in the state where the carriage 50 is in the home position, the portion is extended below, the electrolyte is turned to the electrode 31 and the nozzle 32*b* supplies it. The supply mode of the electrolyte by the nozzle 32*b* may be dropping of the electrolyte as illustrated in FIG. 3A.

Alternatively, as illustrated in FIG. 3B, they may be atomizing of an electrolyte, or injection. These supply modes are suitably chosen by setup of the form of the nozzle 32*b*. As long as the electrolyte is electrolyzed by the supplying of the voltage by the voltage supplying unit 33 and it dissolves the ink, any kind of electrolyte may be used, but water is mentioned as what fulfills this condition.

Then, the electrolyte in this embodiment serves as a liquid which contains at least water. Although the electrolyte may be constituted by only water, an additive may be mixed for the various purpose so that it may mention later. Addition of various surface active agents, alcohols, and ether is also possible because of the soluble improvement in the ink.

As long as the electrolyte is a grade which does not corrode the heads 61Y, 61M, 61C, 61BK, etc., what has to some extent high conductivity may be desirable, and it may contain organic solvents, such as an electrolyte and glycerol.

The power supply 33*a* of the voltage on which the electrolyte electrolyzes the voltage supplying unit 33 as illustrated in FIG. 1, it has a voltage supply control unit which is realized as the electric circuit (not illustrated) which connects the power supply 33*a* to the electrode 31 and the conductive orifice 61*a*, and a part of function of the control part 70, and controls the timing and period of supply of the voltage by the power supply 33*a*.

In the power supply 33*a*, the anode is connected to the electrode 31 by the electric circuit, and the cathode is connected to the conductive orifice 61*a*. Therefore, the voltage supplying unit 33 is provided with electrode 31 as an anode, and is provided with conductive orifice 61*a* as a cathode.

The first cleaning unit 34 includes an rotational shaft 34*a* which is supported rotatably on the main part 99, a blade 34*b* (first cleaning member) which is formed of a rubber as an elastic body supported by the rotational shaft 34*a*, a first cleaning member driving unit (not illustrated) which rotates the rotational shaft 34*a*, and a first cleaning member drive control unit that is realized as a function of the control part 70 to control the first cleaning member driven unit to rise or fall the posture of the blade 34*b*.

Figure 3D:
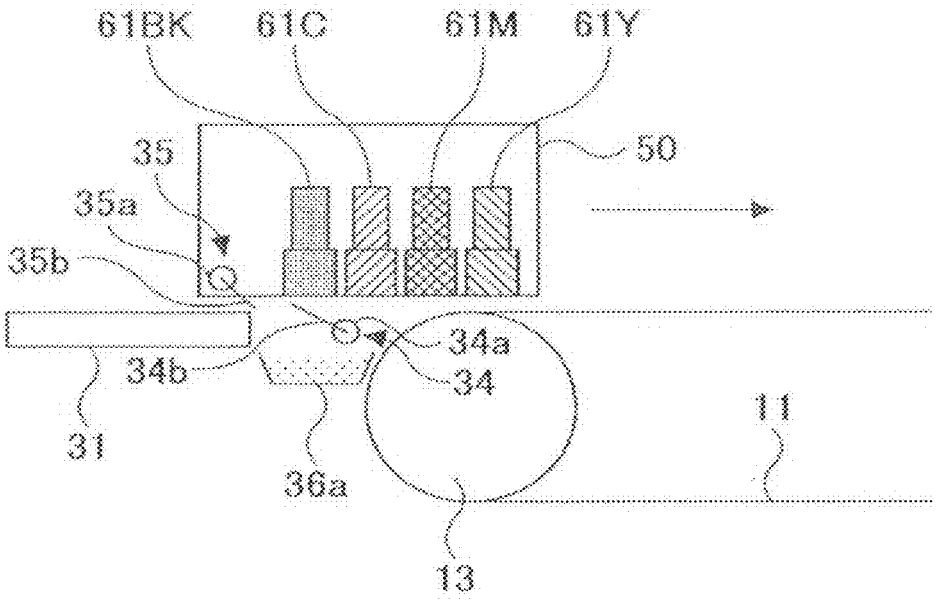

As illustrated in FIGS. 1, 3A, 3B, the first cleaning member driving unit separates the blade 34*b* from the carriage 50 and the heads 61Y, 61M, 61C, 61BK and maintains the blade 34*b* in the first posture which is evacuated from the surface of the copy sheet S (or the transporting passage of the copy sheet S by the belt 11), when the carriage 50 is in the home position, when the carriage 50 moves to the cleaning position from the home position, and when the carriage 50 is in the cleaning position. On the other hand, when the carriage 50 moves to the home position from the cleaning position, the first cleaning member driving unit maintains the blade 34*b* in the second posture in which the head of the blade 34*b* contacts the heads 61Y, 61M, 61C, 61BK as illustrated in FIG. 3C and FIG. 3D.

As illustrated in FIG. 1, the second cleaning unit 35 includes a rotational shaft 35*a* rotatably supported by the carriage 50, the blade 35*b* (the second cleaning member) formed of a rubber as an elastic body supported by the rotational shaft 35*a*, a second cleaning member driving unit (not illustrated) that rotates the rotational shaft 35*a*, and the second cleaning member drive control unit that is realized as a part of the function of the control part 70 and controls the second cleaning member driving unit to rise and fall the posture of the blade 35*b*.

As illustrated in FIGS. 1, 3A, and 3B, the second cleaning member driving unit separates the blade 35*b* from the conveyance surface of the copy sheet S (or the transporting passage of the copy sheet S by the belt 11) and maintains the blade 35*b* in the first posture in which it is contained in the carriage 50 and separated from the belt 11 and the electrode 31, when the carriage 50 in the home position, when the carriage 50 moves to the cleaning position from the home position, and when the carriage 50 is in the cleaning position. On the other hand, when the carriage 50 moves to the home position from the cleaning position, the second cleaning member driving unit maintains the blade 35*b* in the second posture in which the head of the blade 35*b* contacts the electrode 31 as illustrated in FIG. 3C and FIG. 3D.

The first cleaning member driving unit and the second cleaning member driving unit are arranged to return both or one of the blade 34*b* and the blade 35*b* to the first posture at a suitable timing, so that the blade 34*b* and the blade 35*b* in the second posture may not contact each other.

As illustrated in FIG. 1, the recycling unit 36 includes a saucer 36*a* which collects from its lower part the electrolyte removed from the heads 61Y, 61M, 61C, 61BK and the electrode 31 by the first blade 34*b* and the second blade 35*b*, a separation unit 36*b* which separates from the electrolyte the impurity contained in the electrolyte in the saucer 36*a*, a pump 36*c* which returns the electrolyte from which the impurity is removed by the separation unit 36*b*, to the tank 32*a* under pressure, and a pipe 36*d* which interconnects the saucer 36*a*, the separation unit 36*b*, the pump 36*c*, and the tank 32*a* and conveys the electrolyte. In addition, the composition of the head cleaning device 30 will be described later.

In the image forming device 100 of this embodiment, a copy sheet S of one sheet from the paper feeding unit 20 is supplied to the transporting unit 10 upon the input of a predetermined signal indicating a start of image formation. The copy sheet S supplied to the transporting unit 10 is attracted to the upper surface of the belt 11 by the driving of the fan 14 and moved in the direction A1 of the belt 11. While being moved, the surface of the copy sheet S faces the heads 61Y, 61M, 61C, 61BK.

In this process, in accordance with the image to be formed, the ink is discharged from the heads 61Y, 61M, 61C, 61BK to the upper surface of the belt 11, and an image is formed on the surface of the copy sheet S. The copy sheet S with which the image is formed passes through the upper surface top of electrode 31, is guided to the ejection part 25, and is loaded on the ejection part 25.

If the image formation is repeated, the heads 61Y, 61M, 61C, 61BK are in the state where each head is to be cleaned. Specifically, the ink which is discharged from the nozzle 61*c* and reaches the copy sheet S rebounds from the copy sheet S, and with dust and foreign matters adhering to the copy sheet S, the ink adheres to the nozzle 61*c* or its circumference part, and the heads 61Y, 61M, 61C, 61BK become dirty.

Viscosity increases by mixing of the dust, etc. and drying or evaporation of the solvent, and the ink adhering to the heads 61Y, 61M, 61C, 61BK with the dust etc. may cause clogging of the nozzle 61*c* as illustrated in FIG. 4A. If clogging arises, ink is hardly or no longer discharged from the nozzle 61*c*, the flying direction of the ink discharged from the nozzle 61*c* and the speed of the ink will be fluctuated, and the image quality will deteriorate.

Clogging of the nozzle 61*c* is caused by drying of the ink around the nozzle 61*c*, also when the non-use state of the image forming device 100 in which any ink is not discharged from the nozzle 61*c* continues. If the ink adhering to the circumference part of the nozzle 61*c* adheres to the copy sheet S, image quality will deteriorate. In order to prevent such deterioration of image quality, the heads 61Y, 61M, 61C, 61BK will be in the state where it should clean.

When it is needed to clean the heads 61Y, 61M, 61C, 61BK, the carriage 50 moves from the home position to the cleaning position. If the carriage 50 moves to the cleaning position, the heads 61Y, 61M, 61C, 61BK will be cleaned by the cleaning operation described below.

With this cleaning operation, the carriage 50 returns to the home position, in the state in which the heads 61Y, 61M, 61C, the ink discharge from 61BK are possible, and will be in image formation and the state which can be printed.

Next, the cleaning operation by the head cleaning device 30 will be described.

In the image forming device 100, when the control part 70 detects that the accumulated number of image formation sheets or the accumulated number of ink discharge operations reaches a predetermined number, or when it is detected that a predetermined time has passed from the last ink discharge, the control part 70 determines that the state in which the heads 61Y, 61M, 61C, 61BK should be cleaned takes place, and the control part 70 functions as a liquid supply control unit. Under the control of the control part 70, a proper quantity of the electrolyte from the nozzle 61*c* which partially extends downward is supplied to the electrode 31 as illustrated in FIGS. 3A and 3B.

After the supply of the electrolyte by the nozzle 61*c* is completed, the nozzle 61*c* is returned to the original state. Under the control of the control part 70, the carriage 50 is moved to the cleaning position as illustrated in FIG. 3C. When the carriage 50 is in the cleaning position, the electrode 31 and the surface of the heads 61Y, 61M, 61C, 61BK are in the covered state in which they are covered with the electrolyte by applying the electrolyte between the conductive orifices 61*a* between the electrode 31 and the heads 61Y, 61M, 61C, 61BK are formed.

The amount of the electrolyte supplied to electrode 31 by the nozzle 61*c* as showed in FIGS. 3A and 3B is controlled to a sufficient amount needed to reach the covered state.

When the covered state is formed, the control part 70 functions as the voltage supply control unit. The voltage between the conductive orifice 61*a* of each of the heads 61Y, 61M, 61C, 61BK and the electrode 31 is supplied by the voltage supplying unit 33 according to the control by the control part 70, as illustrated in FIG. 4B.

By the supply of the voltage, the ionic reaction processes take place on the conductive orifice 61*a* (which is a cathode) and on the electrode 31 (which is an anode) respectively and the water contained in the electrolyte is electrolyzed as in the following formulas.

$$\text{cathode: } 4H_2O+4e^- \rightarrow 2H_2+4OH^- \qquad \text{formula (1)}$$

$$\text{anode: } 2H_2O \rightarrow 4H^+ + O_2 + 4e^- \qquad \text{formula (2)}$$

To enable these electrolysis reactions to take place, the voltage between the conductive orifice 61*a* and the electrode 31, supplied by the voltage supplying unit 33, has to be higher than 1.23 V that is the theoretical water decomposition voltage.

In addition to the electrolysis reactions by the formulas (1) and (2), the oxidation-reduction reaction may also take place on each of the materials of the conductive orifice 61*a* and the electrode 31 respectively. However, how the oxidation-reduction reaction occurs depends on the kind of each material, the electric potential, and the pH of the electrolyte. It will be easily predictable if the electric potential-pH phase diagram (Pourbaix Diagram) is referred to.

According to the above formula (1), hydroxide ions are produced on the side of the conductive orifice 61*a*, and as a result the electrolyte near the conductive orifice 61*a* is alkaline. Because the coloring material of the ink is an anion type pigment, the ink in the alkali conditions shows high dispersibility. As illustrated in FIG. 4B, the ink adhering to the conductive orifice 61*a* is dissolved in the electrolyte.

According to the above formula (2), hydrogen ions are produced on the side of the electrode 31, and as a result the electrolyte near the electrode 31 is acidic. Because the coloring material of the ink is an anion type pigment, the positive charge of the hydrogen ions and the negative charge of the anion type pigment cancel each other, the electrostatic repulsion is decreased and the phenomenon, such as condensation, thickening, or solidification, easily takes place near the electrode 31 (or on the interface of the electrode 31). As the pigment of the ink near the electrode 31 is condensed, the ink density of the electrolyte interposed between the conductive orifice 61*a* and the electrode 31 is reduced. This promotes the dissolution of the ink adhering to the conductive orifice 61*a*.

If the electrolyte which is a resistance with few electrolyte components is used, the gradient of the electric potential is formed, and the effect of migration of the anion type pigment is also predictable. This enables the component resulting from the ink dissolved in the electrolyte to be transferred to the electrode 31 side. As illustrated in FIG. 4C, the ink components having been transferred to the electrode 31 side are deposited on the electrode 31.

In this manner, the ink adhering to the conductive orifice 61*a* is removed from the conductive orifice 61*a*, the component resulting from the ink is transferred to the electrode 31 side, and the heads 61Y, 61M, 61C, 61BK are cleaned.

In order to perform the reaction promptly and reduce the amount of the electrolyte used, it is preferred that the heads 61Y, 61M, 61C, 61BK and the electrode 31 are located in close proximity. However, if the gap is too small, a short circuit may arise due to sudden vibration, etc. Therefore, the gap between the heads 61Y, 61M, 61C, 61BK and the electrode 31 is preferably in a range of 50 micrometers-2 millimeters, and more suitably it is in a range of 50-200 micrometers.

It is preferred to add diols or triols to the electrolyte in order to raise the surface tension and the viscosity so that the gap between the heads 61Y, 61M, 61C, 61BK and the electrode 31 may be appropriately filled with the electrolyte and the covered state of the electrode 31 in the minute gap may be formed. Moreover, it is preferred to add a defoaming agent to the electrolyte in order to avoid the problem of bubbles which may be formed with a hydrogen gas and an oxygen gas (which have a small solubility to water) produced by the decomposition of the water contained in the electrolyte.

The electrolysis reaction of the water contained in the ink inside the heads 61Y, 61M, 61C, 61Bk is prevented or inhibited by the existence of the insulating orifice 61*b*, and it is possible to prevent the lowering of the ink discharging performance of the head due to development of bubbles in the electrolyte.

As described above, it is necessary that the voltage supplied by the voltage supplying unit 33 is higher than 1.23V. If this condition is met and the period of supply of the voltage is longer or the actually supplied voltage is higher, the cleaning performance of the heads 61Y, 61M, 61C, 61BK will improve. However, if the electrolysis is performed with a too high voltage or a too long supply time, the bubbles are produced, which will be detrimental to the electrolysis reaction. Or the bubbles will enter the heads 61Y, 61M, 61C, 61BK from the nozzles 61*c*, and the ink discharging performance will be reduced or a short circuit will arise. It is preferred that the level of the voltage supplied is in a range of 2-100V, and the period of supply of the voltage is in a range of several microseconds to several seconds.

If the conductivity of an electrolyte is higher, the time for completing the head cleaning operation will be shorter. A conceivable method for improving the conductivity of an electrolyte is to add, to the electrolyte, metal ions (or cations), such as sodium ions. However, such metal ions may act to condense the ink by salting out. Especially, the metal ions whose ionization tendency is lower than that of hydrogen are deposited on the conductive orifice 62*a* (which is the cathode), and the condensed components might be the cause of clogging of the nozzle 61*c*. Care must be taken in adding the metal ions to the electrolyte. In order to avoid the entry of bubbles into the heads 61Y, 61M, 61C, 61BK from the nozzles 61*c*, it is preferred that the direction in which each of the heads 61Y, 61M, 61C, 61Bk discharges the ink from the nozzle 61*c* is the upward perpendicular direction.

Figure 5:
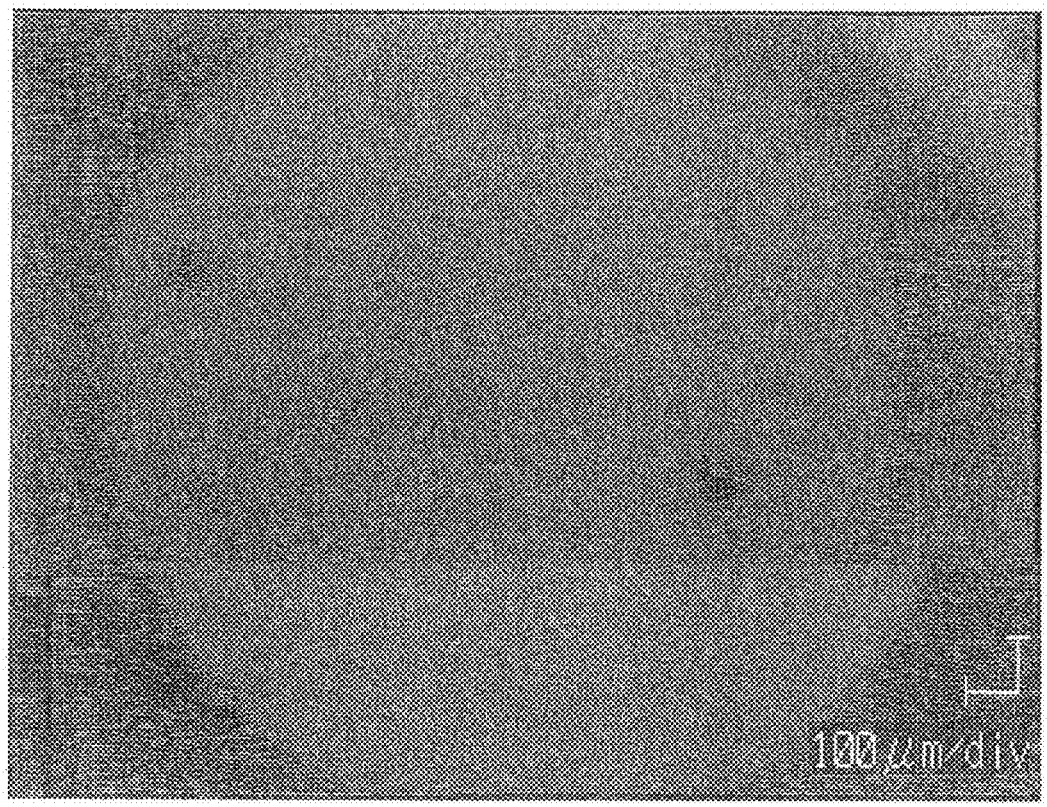
FIG. 5 is a diagram illustrating the result of an experiment for confirming the effect of cleaning the head for removing dirt in the head.

Next, in order to confirm that the head is cleaned by removing the dirt in the head (or the ink adhering to the head), the following experiment has been conducted. FIG. 5 illustrates the result of the experiment. The image in FIG. 5 is an image of the nozzle of the head generated by a digital microscope. The experiment is conducted in a dummy environment using the cathode of a platinum electrode and the anode of a platinum electrode. The detailed conditions of the experiment will be described in the following.

The ink used is a yellow ink which has the following composition. About 1 μL of the ink drop is placed on the platinum electrode (on the cathode side) and subjected to natural drying for one day so that the ink drop adheres to the electrode. The platinum electrode on the anode side is left as it is.

Sulfonic acid group coupled type yellow pigment dispersion liquid (CAB-O-JET-270Y, the solid content: 10 mass %, the product from Cabot Specialty Chemicals Inc.): 40.0 mass %

Triethylene glycol: 15.0 mass %

Glycerol: 25.0 mass %

Propylene glycol monobutyl ether: 6.0 mass %

Dehydroacetic acid soda: 0.1 mass %

Distilled water: residual quantity

After these components are mixed, the resulting liquid is adjusted to pH 9.1 using a 5 mass % solution of lithium hydroxide, and subjected to pressure filtration by a membrane filter with the average pore size of 0.8 micrometers.

The electrolyte used is a transparent ion exchange water. Each of the platinum electrodes used is the product from BAS with the diameter of 1.6 mm, and the whole diameter of the electrode including the PEEK resin is 3.0 mm. The distance between the two platinum electrodes is 2.0 mm, and 10 μL of the ion exchange water which has the electric conductivity of 0.2 mS/m is poured in the gap between the electrodes. The voltage of 10V between the cathode and the anode is supplied for 60 seconds. Simultaneously with the voltage supplying, the ion exchange water turns into yellow.

As the result of the experiment, the ink adhering to the platinum electrode on the side of the cathode is removed from that platinum electrode after the voltage supplying. The component resulting from the ink removed is deposited on the anode side electrode. From the fact that the ink pigment from the cathode side is transferred to the anode side, it is found out that supplying the voltage enables both the dissolution of the ink pigment around the cathode and the deposition of the ink pigment on the anode to be performed smoothly.

In addition, a comparative experiment for the purpose of comparison with the above experiment has been performed as follows. In the comparative experiment, the platinum electrodes are prepared under the conditions that are the same as those of the above experiment, and the electrodes are immersed in the ion exchange water without supplying the voltage. The dissolution of the ink pigment is slower than that of the above experiment (in which the voltage between the electrodes is supplied), and about one hour is needed until the surface of the platinum electrode on the cathode side is completely exposed.

As is apparent from these experiments, the cleaning of the heads 61Y, 61M, 61C, 61BK is performed in the above experiment more quickly than in the case where the heads are simply contacted to the electrolyte. It is conceivable that the head cleaning method of this embodiment provides a high dissolution performance even for the ink subjected to thickening, condensation or solidification, and is more effective than the cataphoresis type cleaning method using the insulating solvent.

Next, the effect of prevention of the clogging of the head has been tested for several examples using the actual ink-jet printer, as illustrated in Table 1 below.

Each of the examples in Table 1 corresponds to the present embodiment of the invention, and each of the comparative examples in Table 1 corresponds to an example different from the present embodiment. The test conditions are as follows.

Because the discharge opening surface of the head has to be conductive, the ink-jet printer GX2500 from Ricoh Company is modified (which will be called modified GX2500) and used as the ink-jet printer to be tested. The material of the electrode confronting to the head is aluminum, the gap between the electrode and the discharge opening surface of the head is equal to 1 mm.

Each of the color inks of black, yellow, magenta, and cyan used has the following composition.

<Black Ink>

Sulfonic acid group coupled type carbon black pigment dispersion liquid (CAB-O-JET-200, the solid content: 20 mass %, the product from Cabot Specialty Chemicals Inc.): 35.0 mass %

2-pyrolidone: 9.0 mass %

Glycerol: 15.0 mass %

Propylene glycol mono-butyl ether: 1.0 mass %

Dehydroacetic acid soda: 0.1 mass %

Distilled water: residual quantity

After these components are mixed, the resulting liquid is adjusted to pH 9.2 using a 5 mass % solution of lithium hydroxide, and subjected to pressure filtration by a membrane filter with the average pore size of 0.8 micrometers. The thus prepared black ink is referred to as ink formula 1.

<Yellow Ink>

Sulfonic acid group coupled type yellow pigment dispersion liquid (CAB-O-JET-270Y, the solid content: 10 mass %, the product from Cabot Specialty Chemicals Inc.): 40.0 mass %

Triethylene glycol: 14.0 mass %

Glycerol: 25.0 mass %

Propylene glycol mono-butyl ether: 7.0 mass %

Dehydroacetic acid soda: 0.1 mass %

Distilled water: residual quantity

After these components are mixed, the resulting liquid is adjusted to pH 9.2 using a 5 mass % solution of lithium hydroxide, and subjected to pressure filtration by a membrane filter with the average pore size of 0.8 micrometers. The thus prepared yellow ink is referred to as ink formula 2.

<Magenta Ink>

Sulfonic acid group coupled type magenta pigment dispersion liquid (CAB-O-JET-260M, the solid content: 10 mass %, the product from Cabot Specialty Chemicals Inc.): 40.0 mass %

Diethylene glycol: 19.0 mass %

Propylene glycol monobutyl ether: 4.0 mass %

Dehydroacetic acid soda: 0.1 mass %

Distilled water: residual quantity

After these components are mixed, the resulting liquid is adjusted to pH 9.2 using a 5 mass % solution of lithium hydroxide, and subjected to pressure filtration by a membrane filter with the average pore size of 0.8 micrometers. The thus prepared magenta ink is referred to as ink formula 3.

<Cyan Ink>

Sulfonic acid group coupled type cyan pigment dispersion liquid (CAB-O-JET-250C, the solid content: 10 mass %, the product from Cabot Specialty Chemicals Inc.): 40.0 mass %

Ethylene glycol: 5.0 mass %

Triethylene glycol: 14.0 mass %

Propylene glycol monobutyl ether: 5.0 mass %

Dehydroacetic acid soda: 0.1 mass %

Distilled water: residual quantity

After these components are mixed, the resulting liquid is adjusted to pH 9.2 using a 5 mass % solution of lithium hydroxide, and subjected to pressure filtration by a membrane filter with the average pore size of 0.8 micrometers. The thus prepared cyan ink is referred to as ink formula 4.

The above-described ink formulas 1 to 4 are all anion type inks.

Example 1

The aluminum electrode of the modified GX2500 is used as the cathode, the gap between the electrode and the head containing ink formula 1 is filled with the electrolyte, and the voltage of 50 V between the electrode and the head is supplied for 5 seconds. The head cleaning device of Example 1 is arranged in this manner. The electrolyte used is an ion exchange water with the electric conductivity of 0.1 m/mS.

Example 2

The head cleaning device of Example 2 is arranged in the same manner as that of Example 1 except that the cathode of Example 1 is changed to the anode.

Example 3

The head cleaning device of Example 3 is arranged in the same manner as that of Example 2 except that the ink formula 1 of Example 2 is changed to the ink formula 2.

Example 4

The head cleaning device of Example 4 is arranged in the same manner as that of Example 2 except that the ink formula 1 of Example 2 is changed to the ink formula 3.

Example 5

The head cleaning device of Example 5 is arranged in the same manner as that of Example 2 except that the ink formula 1 of Example 2 is changed to the ink formula 4.

Example 6

The head cleaning device of Example 6 is arranged in the same manner as that of Example 2 except that the supplied voltage of Example 2 is changed to 100 V.

Comparative Example 1

The head cleaning device of Comparative Example 1 is arranged in the same manner as that of Example 1 except that the supplying of the voltage in Example 1 is not performed.

Comparative Example 2

The head cleaning device of Comparative Example 2 is arranged in the same manner as that of Example 5 except that the supplying of the voltage in Example 5 is not performed.

Evaluation process of each of the above-described examples and the above-described comparative examples (which process is directed to testing the effect of prevention of the clogging of the head) is performed as follows. Using the head which is previously confirmed that many nozzles clog, one drop of the ink is discharged from each of the nozzles of the head before the cleaning operation is performed. The conditions that, when 100 nozzles from which the ink drops discharged at this time are selected, the diameter of a circular image which is formed by each of the ink drops from the selected nozzles is set to about 50 micrometers are determined. After the cleaning operation is performed, a circular image is formed by each of the ink drops from the selected nozzles on the same conditions.

The number 'A' of nozzles with which the drop is located in the target position of the image formed before and after the cleaning operation is counted. The number 'B' of nozzles with which the center position of the image formed is shifted 200 micrometers or more apart from the target position is counted before and after the cleaning operation. Furthermore, the number 'C' of nozzles from which no ink drop is discharged is counted before and after the cleaning operation. The nozzles with which the center position of the image initially formed before the cleaning operation is shifted 200 micrometers or more apart from the target position are withdrawn from evaluation, and the other 100 nozzles are selected as the evaluation object.

TABLE 1

| | 'A' BEFORE CLEAN | 'A' AFTER CLEAN | 'B' BEFORE CLEAN | 'B' AFTER CLEAN | 'C' BEFORE CLEAN | 'C' AFTER CLEAN |
|---|---|---|---|---|---|---|
| Ex. 1 | 43 | 83 | 24 | 7 | 33 | 10 |
| Ex. 2 | 27 | 94 | 48 | 1 | 25 | 5 |
| Ex. 3 | 33 | 95 | 45 | 2 | 22 | 3 |
| Ex. 4 | 35 | 92 | 40 | 3 | 25 | 5 |
| Ex. 5 | 30 | 95 | 37 | 1 | 33 | 4 |
| Ex. 6 | 38 | 98 | 32 | 1 | 31 | 1 |
| C/Ex. 1 | 36 | 38 | 45 | 47 | 19 | 15 |
| C/Ex. 2 | 38 | 39 | 37 | 39 | 25 | 22 |

As is apparent from Table 1, it is found out that, if the clearing operation is performed using any of Examples 1 to 6, the cleaning performance which is mainly directed to the prevention of clogging of the nozzle is appropriate irrespective of the ink formula.

As described in the foregoing, the voltage between the conductive orifice 61*a* of each of the heads 61Y, 61M, 61C, 61Bk and the electrode 31 is supplied by the voltage supplying unit 33, and the conductive orifice 61*a* is cleaned and the clogging of the nozzle 61*c* can be easily prevented. The component resulting from the ink removed from the conductive orifice 61*a* by the cleaning operation is deposited on the electrode 31. In a certain case, the component resulting from the additive contained in the electrolyte may be deposited on the electrode 31.

In order to restart the subsequent image formation, it is necessary to return the carriage 50 back to the home position, remove the electrolyte from the conductive orifice 61*a*, and remove the electrolyte and the deposition from the electrode 31. At this time, the control part 70 sets the blade 34*b* (which functions as a first cleaning member driving unit) to the second posture, sets the blade 35*b* (which functions as a second cleaning member driving unit) to the second posture, and returns the carriage 50 back to the home position.

In progress of this movement, the blade 34*b* acts to remove the electrolyte, the ink or the component resulting from the ink from the orifice conductive 61*a* (each of the heads 61Y, 61M, 61C, 61Bk). The blade 35*b* acts to remove the electrolyte or the component resulting from the ink from the electrode 31.

In this manner, the cleaning of the heads 61Y, 61M, 61C, 61BK is performed and the cleaning of the electrode 31 is also performed. In consideration of a possibility that the electrolyte remains on the heads 61Y, 61M, 61C, 61BK, the fan 14 is driven as an air flow generation unit, and the air flow generated may perform drying of the heads 61Y, 61M, 61C, 61BK. Although the electrolytes removed from the heads 61Y, 61M, 61C, 61BK, and the electrode 31 by the blade 34*b* and the blade 35*b* are collected by saucer 36*a* and it is returned to tank 32*a* through pipe 36*d* by the drive of pump 36*c*. In this process, when passing separation unit 36*b*, it dissociates from the electrolyte and changes into the pure state the component resulting from ink contained in the electrolyte, the edge dust adhering to a copy sheet S, etc. Therefore, the electrolyte returned to tank 32*a* functions good also in the case of an activity for the second time.

The separation unit 36*b* is provided with the filter 89 and the filter (not illustrated) which has the same composition in order to perform this separation. In order to cope with deterioration of temporal clogging of the filter etc., the separation unit 36*b* is made exchangeable by the same composition as the fastener 91 while considering it as the same composition as the filter cartridge 92.

The separation unit 36*b* may be replaced with the composition of the filter, and may be provided with a deposit component decomposition unit, such as a hydrogen-ion-concentration adjusting unit for decomposing the components resulting from the ink and deposited on the electrode 31.

In order to remove the bubbles generated by the recycling, the exhaust unit 86 and the same exhaust unit may be provided in the tank 32*a*. However, recycling of the collected electrolyte is not indispensable and it may be made to dry the electrolyte collected on the saucer 36*a* by natural seasoning etc.

Next, some modifications of the head cleaning device 30 of this embodiment will be described.

About the composition same with having already explained, the same reference numeral is attached in the above-mentioned drawings, and a description thereof will be omitted suitably.

The heads 61Y, 61M, 61C, 61BK and the covered state where it covered with the electrolyte between and the electrode 31 are not limited only to forming according to the dropping of the electrolyte, and atomizing. Another mode (for example, the mode of spreading as in FIG. 6) may be performed.

Figure 6:
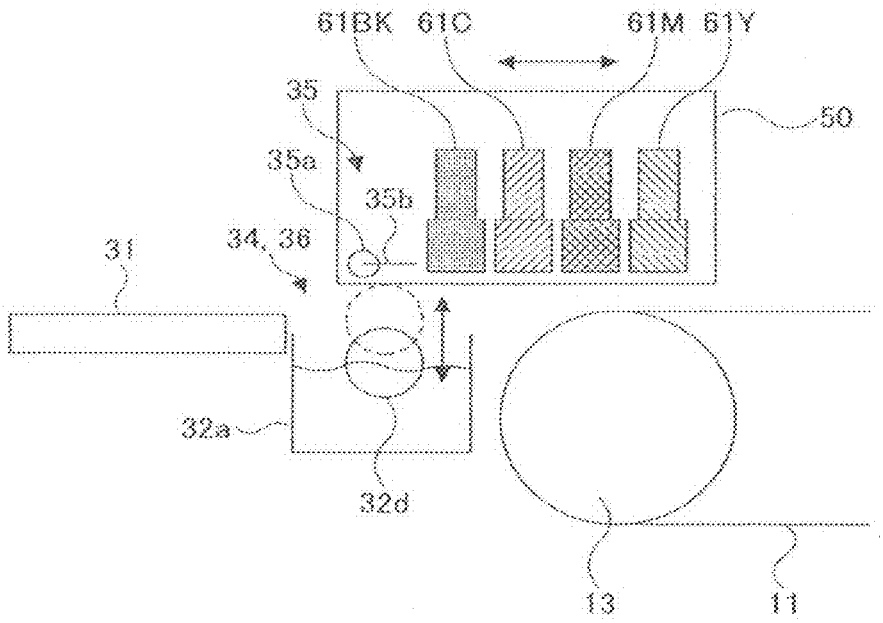
FIG. 6 is a diagram illustrating the composition of a modification of the principal part of the head cleaning device illustrated in FIG. 1.

As the electrolyte container part in which liquid supplying unit 32 illustrated in FIG. 6 contained the electrolyte. On the main part 99, in the tank 32*a* and the rotation roller 32*d* as an electrolyte applying member supported free. It includes a liquid supply control unit which is realized as a part of applying member driving unit (not illustrated) which drives roller 32*d* up and down, and function of the control part 70, and controls the drive timing of roller by the applying member driven unit 32*d* vertical movement.

Specifically, the state of occupying an upper dead point while roller 32*d* is immersed in the electrolyte in the tank 32*a* in the bottom dead point, the heads 61Y, 61M, 61C, 61BK in the position where the circumference contacts the conductive orifice 61*a* is occupied.

When the carriage 50 moves the liquid supply control unit to the cleaning position from the home position, the electrolyte currently supported by the roller 32*d* is applied to the conductive orifice 61*a*, moving the roller 32*d* to the upper dead point, and making movement of the conductive orifice 61*a* carry out follower rotation of the roller 32*d*.

The roller 32*d* serves also both as the first cleaning member in the first cleaning unit 34, and recycling unit 36. When the carriage 50 moves to the cleaning position from the home position, even if it passes the roller 32*d*, the upper dead point position is maintained.

After the end of cleaning, when the carriage 50 returns to the home position from the cleaning position, the electrolyte adhering to the conductive orifice 61*a* is removed and collected to the conductive orifice 61*a*, carrying out follower rotation.

The liquid supplying units 32 are modes, such as dropping, atomizing, and spreading, and they can be constituted so that the electrolyte may be supplied. The supply timing of the electrolyte is enough, if the covered state is formed after the heads 61Y, 61M, 61C, 61BK and the electrode 31 have faced.

Figure 7:
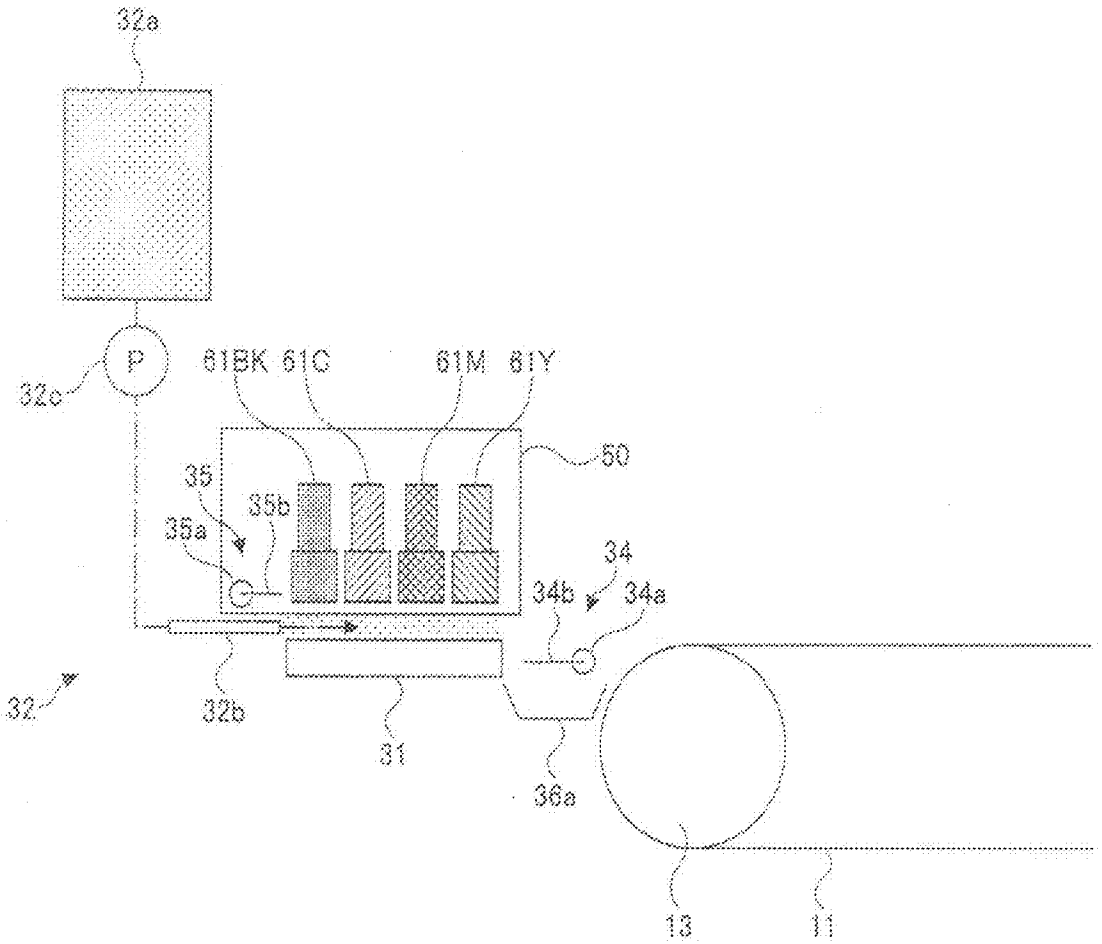
FIG. 7 is a diagram illustrating the composition of another modification of the principal part of the head cleaning device illustrated in FIG. 1.

As mentioned above, before the heads 61Y, 61M, 61C, 61BK and the electrode 31 face, or at the time of the heads 61Y, 61M, 61C, 61BK and the electrode 31 facing each other, as illustrated in FIG. 7, the supply mode of the electrolyte in FIG. 7 is the heads 61Y, 61M, 61C, 61BK as opposed to the gap between the conductive orifice 61*a* and the electrode 31.

Thus, the object for supply of the electrolyte by liquid supplying unit 32 may be electrode 31 as illustrated in FIG. 3A. As illustrated in FIG. 6, it may be conductive orifice 61*a*. Or it may be conductive orifice 61*a* and electrode 31 which are illustrated in FIG. 7. Even if the objects for supply of the electrolyte by liquid supplying unit 32 are any, the supply mode of the electrolyte can combine which the above-mentioned mode freely.

The cleaning unit may be arranged to remove the electrolyte from the heads 61Y, 61M, 61C, 61BK and the electrode 31 by suction, without using the blades 34*b* and 35*b* and the roller 32*d*. For example, in the example illustrated in FIG. 7, the pump 32*c* is arranged sp that the pump 32*c* can be driven in either the forward direction or the reverse direction. After the cleaning operation is performed, the pump 32*c* is driven in the reverse direction to attract the electrolyte by the nozzle 32*b*, so that the electrolyte is removed from the heads 61Y, 61M, 61C, 61BK and the electrode 31. In this case, the liquid supplying unit 32 functions as the cleaning unit and the recycling unit. Also in this case, a separation unit which is the same as described above may be arranged in the recycling unit. In order to remove the bubbles generated by the recycling, an exhaust unit which is the same as the exhaust unit 86 may be provided in the tank 32*a*.

The liquid supplying unit 32 may be constituted by at least one of the ink discharging devices 60Y, 60M, 60C, 60BK. In this case, when the heads 61Y, 61M, 61C, 61BK are in the cleaning position to face the electrode 31, the ink is discharged from the head selected from among the ink discharging devices 60Y, 60M, 60C, 60BK as the liquid supplying unit 32, the resulting ink is used as the electrolyte, and the covered state is formed. Because the ink is a water-soluble ink, good cleaning performance can be attained by the electrolysis of the water contained in the ink.

If all of the ink discharging devices 60Y, 60M, 60C, 60BK are chosen as the liquid supplying units 32, the covered state is formed promptly. However, as illustrated in FIG. 1, the ink cartridge 81BK which contains the black ink has the largest capacity of ink among the ink cartridges 81Y, 81M, 81C, 81BK. Taking into consideration the ink quantity consumed as the electrolyte, only the ink discharging device 60BK may be chosen as the liquid supplying unit 32. To prevent the pigment of the ink used as the electrolyte from staining the copy sheet S or the image forming device 100, only the ink discharging device 60Y may be chosen as the liquid supplying unit 32, because the color yellow is the least conspicuous among yellow, magenta, cyan, and black.

When one of the ink discharging devices 60Y, 60M, 60C, 60BK is used as the liquid supplying unit 32 and the ink of a corresponding color having been used as the electrolyte is recycled, it is desirable that the collected electrolyte be returned to the ink cartridge of the corresponding color, from the viewpoint of color mixture prevention. When the inks of two or more colors are used as the electrolyte, it is desirable that the collected electrolyte be returned to the ink cartridge 81BK, because the influence of the color change due to mixing of other colors is the smallest.

In the foregoing embodiment, the image forming device 100 is of direct transfer type that performs image formation by transferring the color image directly to the copy sheet S. Alternatively, the image forming device 100 may be of indirect transfer type that includes an intermediate transfer medium 37 and performs image formation by transferring the color image in an indirect manner as illustrated in FIG. 8.

Figure 8:
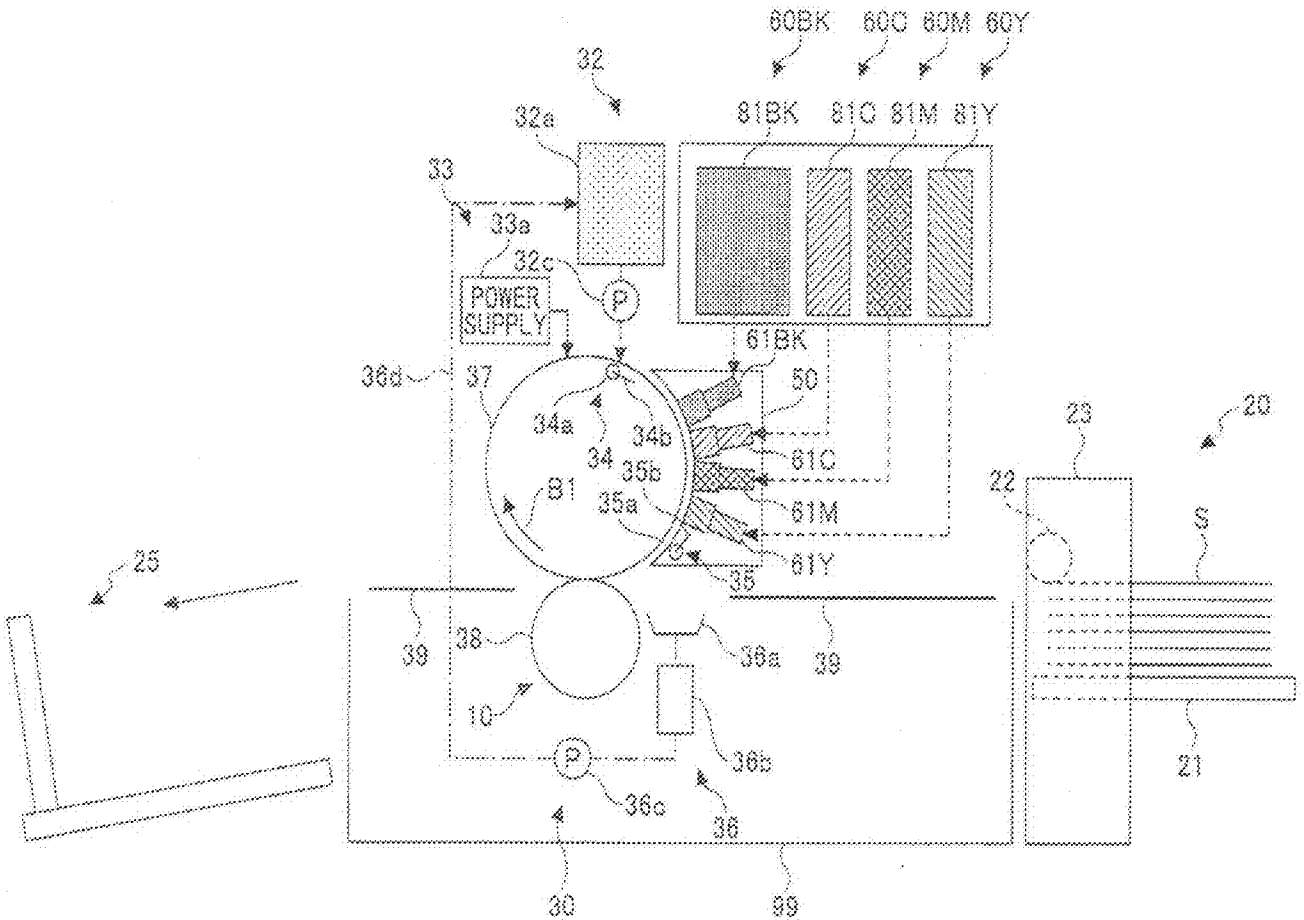
FIG. 8 is a diagram illustrating the composition of an image forming device including a head cleaning device of another embodiment of the invention.

In the image forming device 100 in FIG. 8, the intermediate transfer medium 37 is used as the electrode 31 as in the previous embodiment of FIG. 1. Thereby, when cleaning the heads 61Y, 61M, 61C, 61BK, it is not necessary to move the carriage 50 to the cleaning position. It is possible to speed up the cleaning operation. If the heads 61Y, 61M, 61C, 61BK are of the full line type, the fixed mount type in which the heads 61Y, 61M, 61C, 61BK and the carriage 50 are fixed together may be used instead.

In FIG. 8, reference numeral 38 denotes a transfer roller which is arranged in the transporting unit 10 to face the intermediate transfer medium 37, and follows the rotation of the intermediate transfer medium 37, and reference numeral 39 denotes a guide plate which guides a copy sheet S sent from the paper feeding unit 20 to the transfer part between the intermediate transfer medium 37 and the transfer roller 38, and guides the copy sheet S sent from the transfer part to the ejection part 25.

In addition, the image forming device 100 in FIG. 8 further includes an intermediate transfer medium driving unit (not illustrated) which rotates the intermediate transfer medium 37 in the clockwise direction indicated by the arrow B1.

At least the surface of the intermediate transfer medium 37 in this embodiment is made of a material that is the same as the material of the electrode 31 in the previous embodiment of FIG. 1. The power supply 33*a* is connected to this material of the surface of the intermediate transfer medium 37.

The first cleaning unit 34 is disposed in the intermediate transfer medium 37. The blade 34*b* is maintained in the first posture (in which the blade 34*b* is located inside the circumference of the intermediate transfer medium 37) at the time of the image formation operation, except for the time of removing the electrolyte from the conductive orifice 61*a* during the cleaning operation.

In the image forming device 100 of this embodiment, upon receipt of a predetermined signal indicating a start of image formation, the intermediate transfer medium 37 is rotated in the B1 direction, while facing the heads 61Y, 61M, 61C, 61BK. During this process, the inks of yellow, magenta, cyan, black are discharged from the heads 61Y, 61M, 61C, 61BK, sequentially from the upstream to the downstream in the B1 direction at shifted timings in a manner that the color images of yellow, magenta, cyan, black are overlapped at the same position of the intermediate transfer medium 37. Consequently, the composite color image is temporarily supported on the intermediate transfer medium 37.

A copy sheet S sent from the paper feeding unit 20 is supplied to the transfer part in accordance with the timing which the leading edge of the image supported on the intermediate transfer medium 37 reaches the transfer part. The transfer roller 38 is rotated by the intermediate transfer medium 37, and the image supported on the intermediate transfer medium 37 is transferred to the copy sheet S passing by the transfer part, so that an image is formed on the surface of the copy sheet S. The copy sheet S on which the image is formed is guided to the ejection part 25 and stacked on the ejection part 25.

When the control part 70 determines after the image formation described above that the heads 61Y, 61M, 61C, 61Bk are to be cleaned, the cleaning operation of the heads 61Y, 61M, 61C, 61BK is started. In order to set the intermediate transfer medium 37 in a covered state in which the gap between the heads 61Y, 61M, 61C, 61BK and the intermediate transfer medium 37 is covered with the electrolyte, while the intermediate transfer medium 37 is rotated in the B1 direction, the electrolyte is supplied from the liquid supplying unit 32 to the gap. The electrolyte is supplied to the position of the intermediate transfer medium 37 confronting to the position of the heads 61Y, 61M, 61C, 61Bk, so that the covered state is established.

Depending on the viscosity and the surface tension of the electrolyte used, the formation of the covered state may be performed as follows. The electrolyte is supplied to the intermediate transfer medium 37 when the rotation of the intermediate transfer medium 37 is stopped, and the electrolyte supplied to the intermediate transfer medium 37 is allowed to move the confronting position of the intermediate transfer medium 37 by the action of gravity, so that the electrolyte may not leak from the confronting position.

After the covered state is formed, the voltage between the intermediate transfer medium 37 and the conductive orifice 61*a* is supplied by the voltage supplying unit 33 in the same manner, so that the conductive orifice 61*a* is cleaned. When the voltage supplying is performed, the rotation of the intermediate transfer medium 37 may be stopped. However, when the time for performing the voltage supplying is short and the covered state is maintained, the rotation of the intermediate transfer medium 37 may be continued.

Subsequently, in the state in which the blade 34*a* and the blade 35*b* are set in the second posture, the intermediate transfer medium 37 is rotated in the B1 direction, and the electrolyte is removed from the heads 61Y, 61M, 61C, 61BK and the intermediate transfer medium 37 by the blade 34*a* and the blade 35*b*.

Other operations of the image forming device 100 of this embodiment are the same as those of the previous embodiment described above.

The image forming device of the type including the intermediate transfer medium is generally provided with an intermediate transfer medium cleaning unit that cleans the intermediate transfer medium. If this intermediate transfer medium cleaning unit is arranged to include the second cleaning unit 35, either of these components may be omitted. This allows simplification of the structure, miniaturization, and low-cost production of the image forming device.

The present invention is not limited to the specifically disclosed embodiments, and variations and modifications may be made without departing from the scope of the present invention.

For example, the coloring material of the ink used in the foregoing embodiments is ionized in the solvent and works as anions and the electrode works as an anode. Alternatively, this positive/negative arrangement may be reversed, the coloring material of the ink may be ionized in the solvent and work as cations, and the electrode may work as a cathode. In this case, the positive/negative electrodes of the power supply are made contrary to those of the foregoing embodiments and the conductive member may work as an anode. Also, in this case, the material of the electrode and the material of the conductive member are reversed contrary to those of the foregoing embodiments.

In the embodiment illustrated in FIG. 1, the electrode is located in the transporting passage of a recording medium, and the head is moved in the direction parallel to the transporting passage to the cleaning position, facing the electrode, where the head is evacuated from the image formation position. Alternatively, the position evacuated from the image formation position may be a side position with respect to the transporting passage of the recording medium, and the electrode may be disposed in a corresponding position to the side position.

If the evacuated position of the head in the state where the head is evacuated from the image formation position to face the electrode is a position apart from the transporting passage of the recording medium, the influence on the image formation by the adhering liquid when the electrolyte or the ink adhere to the electrode can be minimized. If the evacuated position of the head is a home position at a time different from the time of image formation, it is possible to clean the head without moving the head to another position at the time different from the time of image formation by starting the cleaning operation promptly.

In the foregoing embodiments, after the covered state is formed, the voltage supplying is started by the voltage supplying unit. Alternatively, the voltage supplying may be started by the voltage supplying unit before the covered state is formed or during the formation of the covered state. The electrolyte may contain have some which will be in the state of having the character to dissolve ink by electrolysis even if they are construction material other than water, they should just include the construction material at least.

The image forming device according to the invention may be of other types, different from the type of the image forming device of the foregoing embodiments, including a copier, a facsimile, a monochrome multi-function peripheral, a color multi-function peripheral, an image forming device used to form an electric circuit, and an image forming device used to form a predetermined image in a biotechnology field.

It is possible for the head cleaning device of at least one of the embodiments of the invention to clean the head promptly and appropriately by using the electrolyte in which the water-soluble ink is dissolved by electrolysis, and to maintain the head in an appropriate state for contributing to the performance of image formation with good quality. Moreover, it is possible for the head cleaning method of at least one of the embodiments of the invention to clean the head promptly and appropriately by using the electrolyte in which the water-soluble ink is dissolved by electrolysis, and to maintain the head in an appropriate state for contributing to the performance of image formation with good quality.

The present application is based on Japanese patent application No. 2009-056648, filed on Mar. 10, 2009, the contents of which are incorporated herein by reference in their entirety.

The invention claimed is:

1. A head cleaning device comprising:

an electrode disposed in a position confronting to a bottom of a head in a cleaning position, the head including nozzles for discharging a water-soluble ink, the electrode being set in a covered state to provide a surface covered with an electrolyte which, when electrolyzed, dissolves the water-soluble ink;

a liquid supplying unit that supplies the electrolyte to the electrode so that the electrode is set in the covered state; and a voltage supplying unit that supplies a voltage between the head and the electrode to electrolyze the electrolyte on the surface of the electrode in the covered state.

2. The head cleaning device according to claim 1, further comprising:

a conductive member disposed on the head, the voltage between the head and the electrode being supplied through the conductive member by the voltage supplying unit; and an insulating member that provides an insulation between the conductive member and the water-soluble ink contained in the head, the insulating member and the conductive member forming a part of the nozzle.

3. The head cleaning device according to claim 1, further comprising a cleaning unit that removes at least one of the electrolyte and the water-soluble ink from at least one of the electrode and the head to which the voltage is supplied by the voltage supplying unit.

4. The head cleaning device according to claim 1, further comprising a recycling unit that collects the electrolyte from at least one of the electrode and the head to which the voltage is supplied by the voltage supplying unit, and recycles the electrolyte to the liquid supplying unit.

5. The head cleaning device according to claim 4, wherein the recycling unit includes a separation unit that separates a component of the water-soluble ink from the collected electrolyte.

6. The head cleaning device according to claim 1, wherein the electrode is disposed in the position that confronts to the bottom of the head in the cleaning position different from a home position of the head where the head performs image formation by discharging the water-soluble ink from the nozzles of the head.

7. The head cleaning device according to claim 1, wherein the electrode is constituted by an intermediate transfer medium which temporarily supports the water-soluble ink discharged from the nozzles of the head.

8. The head cleaning device of according to claim 1, wherein the electrolyte contains at least water, and the water contained in the electrolyte is electrolyzed to dissolve the water-soluble ink.

9. The head cleaning device according to claim 1, wherein the liquid supplying unit is constituted by the head.

10. An image forming device in which the head cleaning device according to claim 1 is arranged.

11. The image forming device according to claim 10, wherein the water-soluble ink contains at least a coloring material and a solvent of the coloring material, the coloring material is ionized in the solvent and works as anions, and the electrode works as an anode.

12. The image forming device according to claim 10, wherein the water-soluble ink contains at least a coloring material and a solvent of the coloring material, the coloring material is ionized in the solvent and works as cations, and the electrode works as a cathode.

13. A head cleaning method using a head cleaning device, comprising:

providing an electrode disposed in a position confronting to a bottom of a head in a cleaning position, the head including nozzles for discharging a water-soluble ink, the electrode being set in a covered state to provide a surface covered with an electrolyte which, when electrolyzed, dissolves the water-soluble ink;

supplying, by a liquid supplying unit of the head cleaning device, the electrolyte to the electrode so that the electrode is set in the covered state; and supplying, by a voltage supplying unit of the head cleaning device, a voltage between the head and the electrode to electrolyze the electrolyte on the surface of the electrode in the covered state.

* * * * *